US011306750B2

(12) United States Patent
Shu

(10) Patent No.: US 11,306,750 B2
(45) Date of Patent: Apr. 19, 2022

(54) UNIVERSAL VANE ACTUATOR SYSTEM WITH CORNER SEALS AND DIFFERENTIAL ROTATION MECHANISMS

(71) Applicant: Jianchao Shu, Cypress, TX (US)

(72) Inventor: Jianchao Shu, Cypress, TX (US)

( * ) Notice: Subject to any disclaimer, the term of this patent is extended or adjusted under 35 U.S.C. 154(b) by 142 days.

(21) Appl. No.: 16/443,824

(22) Filed: Jun. 17, 2019

(65) Prior Publication Data

US 2019/0352967 A1 Nov. 21, 2019

Related U.S. Application Data

(60) Provisional application No. 62/671,989, filed on Jun. 17, 2018.

(51) Int. Cl.

| | |
|---|---|
| ***F15B 15/18*** | (2006.01) |
| ***F01D 17/16*** | (2006.01) |
| ***E21B 21/08*** | (2006.01) |
| *F15B 15/12* | (2006.01) |
| *E21B 34/04* | (2006.01) |

(52) U.S. Cl.

CPC ..... *F15B 15/18* (2013.01); *E21B 21/08* (2013.01); *F01D 17/16* (2013.01); *E21B 34/04* (2013.01); *F15B 15/12* (2013.01)

(58) Field of Classification Search

CPC . E21B 43/24; F15B 15/12; F16K 5/06; F16K 17/04; F16K 17/16; F16K 17/168; F16K 25/04; G05D 16/106

See application file for complete search history.

(56) References Cited

U.S. PATENT DOCUMENTS

| | | | | | |
|---|---|---|---|---|---|
| 540,492 | A * | 6/1895 | Humes | F04C 9/002 | 417/482 |
| 2,780,432 | A * | 2/1957 | Shafer | F16K 31/14 | 251/59 |
| 2,795,212 | A * | 6/1957 | Shafer | F16K 31/12 | 91/395 |
| 2,966,144 | A * | 12/1960 | Self | F15B 15/12 | 92/122 |
| 3,207,048 | A * | 9/1965 | Rumsey | B60P 1/5433 | 92/125 |
| 3,377,923 | A * | 4/1968 | Steinbach | F15B 15/12 | 92/121 |

(Continued)

*Primary Examiner* — Kenneth Bomberg
*Assistant Examiner* — Matthew Wiblin

(57) ABSTRACT

This invention relates to a versatile rotary vane actuator module and a thermal actuation system with universal adaptable shafts/installation and differential rotary and turbocharger mechanisms to actuate 0-360 degree or more for complicated, precision, extreme rotary applications like robotic excavators, airplanes, heavy or weapon machinery, satellite receivers or wind turbine position controls, remote pipeline valves, HIPP or subsea valves and BOP controls, the thermal actuation system includes three thermal elements (1) pressure sources (2) volume vessel (3) heat sources, the vane actuator comes with redundant edge seals and corner seal rings to minimize or eliminate the inherent leakage and the differential rotation mechanism and the turbocharger with a dynamic porting system to expand the rotation 360 degree more efficiently, the actuator module includes a least one housing assembly, at least one driver assembly and at least one dynamic embedded porting system.

17 Claims, 7 Drawing Sheets

(56) References Cited

U.S. PATENT DOCUMENTS

| | | | | |
|---|---|---|---|---|
| 3,554,096 | A | 1/1971 | Dejager | |
| 4,475,738 | A * | 10/1984 | Eicher | F16J 15/545 277/345 |
| 5,975,106 | A * | 11/1999 | Morgan | A62C 2/04 137/78.5 |
| 6,520,068 | B1 * | 2/2003 | Collier | B25J 9/148 92/124 |
| 7,334,514 | B2 | 2/2008 | Shu | |
| 8,915,176 | B2 | 12/2014 | Henrickson | |
| 10,222,812 | B2 | 3/2019 | Shu | |
| 2014/0219771 | A1 * | 8/2014 | Henrickson | F01D 9/04 415/1 |
| 2016/0273561 | A1 * | 9/2016 | LeBlanc | F15B 1/024 |
| 2017/0220053 | A1 * | 8/2017 | Shu | F16K 17/16 |
| 2018/0283561 | A1 | 10/2018 | Shu | |

* cited by examiner

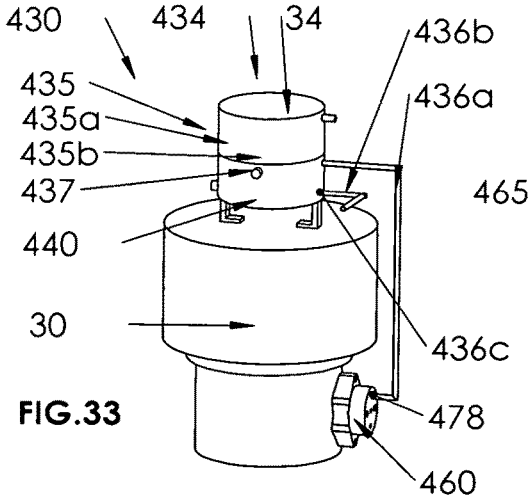
FIG.33
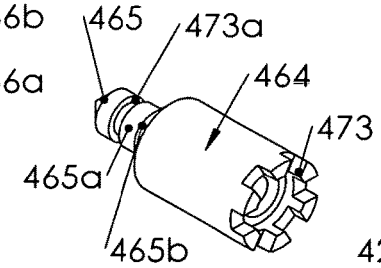
FIG.35b
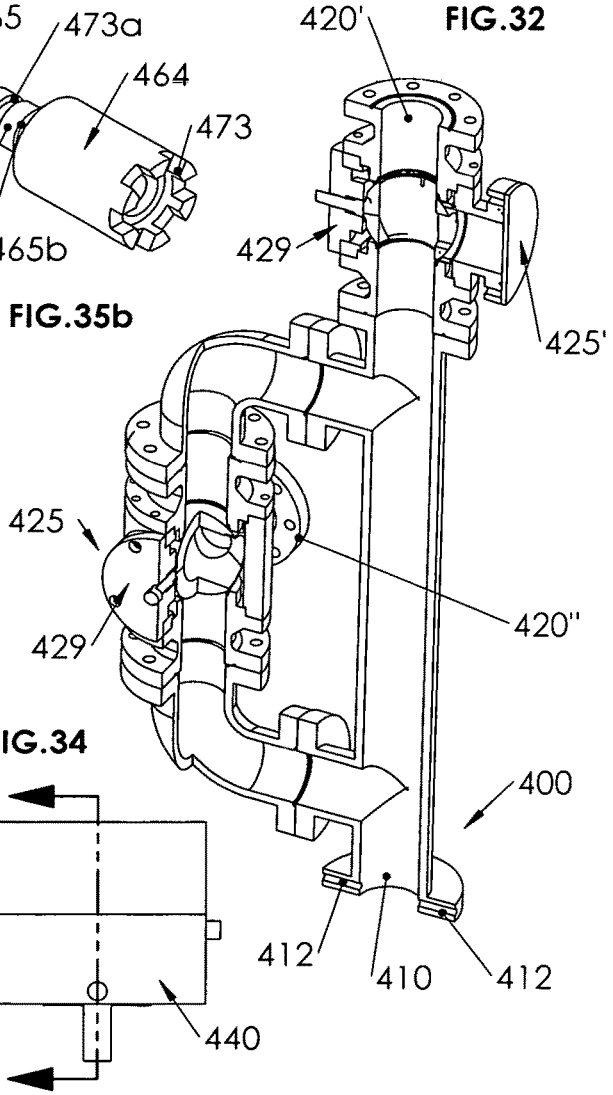
FIG.32
FIG.34
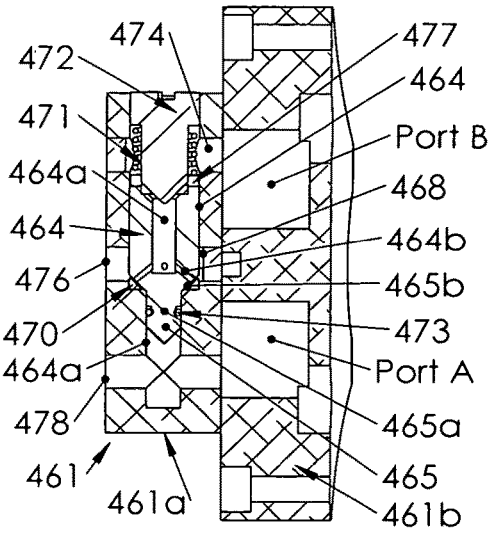
FIG.35a
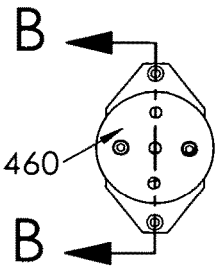
FIG.35
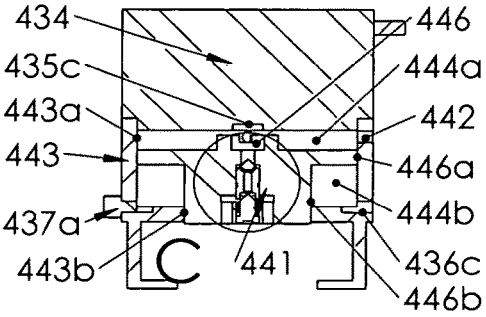
FIG.34a
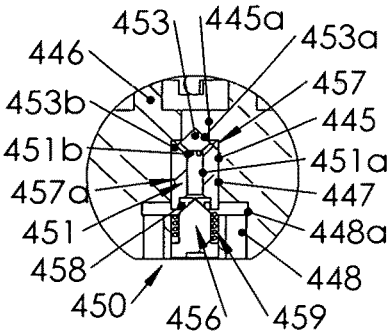
FIG.34b

UNIVERSAL VANE ACTUATOR SYSTEM WITH CORNER SEALS AND DIFFERENTIAL ROTATION MECHANISMS

BACKGROUND

This invention relates to an universal fluid control system in a fluid process station with imbedded universal pressure protections for critical services in pipelines, power plants and subsea and chemical plants, airplane/earth moving equipment actuation systems as well as jet fuel delivery systems and rock engine propulsion systems, the system is based on the advanced design method—a descriptive design method with two steps (1) to tell or describe a product life story through three stages: design, process and operation with multiple product frames between a success mode and failure mode in dynamic details through computation tools and scientific reasoning as a movie script (2) to iterate three processes; creating, materializing, breaking to redefine the boundary between the success mode and the failure mode at each iteration, this cutting edge tool is to create the best components and to optimize them for the best system performances in an unprecedented way, this fluid control system is designed through a drive train optimizer and an energy distributer and solid fluid metrics, and not only provides the highest safety for products and environment, but also carry out complicated control operations and is scalable and flexible and predictable and has multiples subsystems with valves, an actuation-control assemblies through the drive train designs, an energy distribution through the thermal power supplier (pressure, volume and heat to power the drive train, finally solid-fluid interacting analyzer to analyze each interaction between solid and fluid related to each drive train action and each energy consumption to improve the performances in term of efficiency, sealabilty and reliability and accuracy, they would seamless integrate as a system which is never done before, specially the unique components like a control chamber assembly as a brain integrated with a 360 degree leak-less rotary vane actuator as muscles and universal shuttle valves performing fluid traffic controls as a heart.

Why we need new methods, tools and products? Because there are so many problems with the older product, tools and methods, the conventional vane actuators and all related prior arts and products on the markets have come with ten inherent problems over more than 100 years.

(1) High leakage at corners as well as top and bottom surfaces, so far there are no good solutions, the experts in the filed claim that the leak for the van actuator is unavoidable, http://blog.parkercom/know-your-pneumatics-which-rotary-actuator-should-i-choose, but it is the reality for now, whether or not so many related prior arts in the fields claim or some claim that their products or patents are different, so some vane actuators have a single vane with large radial corners to overcome the problems, the solutions are not desirable due to lager side load and cross side vane engagement, low efficiency and top and bottom leaks, other some just get of rid of the corner seals, the new similar patents still come out, the old problem is still with us, unless the vane become circular or round, there are top and bottom side leaks, why we care? Because the leakage still presents big challenges for precision volume control or position control applications or from points of efficiency and reliability.

(2) side load, single vane actuator can ease leakage issue but creates unbalanced side load on the shaft as well as the vane and greatly reduce product life and efficiency and cause shaft leakage specially for heavy load and high speed, the balanced forces cause prematurely, the actuators only last a few weeks.

(3) limitation of rotation, unlike helical or rack/pinion rotary actuators, most vane actuator has limit of the rotation angle from 60 with three vanes to 280 degrees with one vane, for examples single vane actuator cannot reach 360 degree or two-vane actuator cannot reach to 180 degree, that only would greatly reduce the scope of applications against the helical rotary actuators.

(4) Lack of stiffness of moment, because the vane actuator has no linear to rotation converting mechanism, so it has very low stiffness of movement or holding torque in comparison with rack and pinion actuators or helical actuator and is not suitable for those operations of precision position without constant pressurized fluid like rotary lifters, actuating hinges, airplane flight controller.

(5) lack of relative position control, for precision rotation control like valve control, satellite receiver controls or wind turbine direction controls, as well as subsea valve control systems, the position adjustment is very important, but 99% of the adjustments are relative position control between a rotary shaft and an installing flange plate between 90 degree with a float start point not absolute position control between 0-90 degree.

(6) Lack of modulation design and adaptability, for two or three dimension motion control, two or three actuators are needed, but there is no optimized joint method for conventional actuators, In order to meet ISO 2511, many manufacturers have to make various shaft adapters to meet the ISO 2511 shaft types.

(7) lack of method for full stroke test under IEC61508, IEC61511, ANSI/ISA-84.00.01, the partial stroke tests miss critical part of the stroke which is closed to full closed positions which the torque increase greatly, so it is never reliable solution. So far there is no valve actuation system can be tested for full stroke test without stopping operations.

(8) lack of robust, versatile porting systems, most of the porting systems are static, only for one or two cavities, such the porting system cannot run complicated operations like sequence operations, speech control by selecting number of active cavities 1, 2, or 3 . . . N, most of 2 dimensional or 3 dimensional control actuators are equipped with external hose or tubing for the interconnection among the actuation models, the interconnections cause the most of leaks and failure due to harsh working conditions, corrosion or accident hits and is the weakest link in the actuation system, moreover for most fast shut off valve or fast cycled valves, the fast closing actuation is an eternal struggle, with the speech less than one or two seconds, the valve seat and packing were damaged and replaced constantly even every operation, while with less than one or two seconds speech, like LNG terminal shutoff valves, they would be frozen and cannot be operated, or rocket engine fuel delivery system with fluid mixing of liquid oxygen and hydrogen, any wrong mixing can cause explosive or missing ignition, or like refiner or chemical plant shutoff valves, they can cause explosion, fire and release toxic gas and kill people.

(9) Heavy weights and large size, either single vane actuators or double vane actuators have higher weights of the housing and vanes, for high pressure, the vane actuators have the heavy, large housings with the thick walls for bolting as well as heavy, thick vanes, while for pneumatic low pressure, the single vane actuators have thick and heaver vane with multiple seal layers with the solid shaft and heavy and large housing with low strength of die aluminum and reinforced ribs, those vane actuators have the high purchasing cost due to very low torque density (torques/weights) and have high operation cost due to low fluid efficiency (torque/fluid volume)

(10) Energy waste, most actuators operate with a great amount leakage with incoming high pressurized fluid from one port and release high pressurize fluid into other port in order to actuate the drive shaft, those operations waste great amount of high pressurized fluid into the releasing port never recycle the high pressurized fluid.

So the flow control industry has long sought means of improving the performance of the vane actuators, improving the seal, creating a robust actuation system under multiple extreme conditions.

In conclusion, insofar as I am aware, no such a system is formerly developed without the above limits or problems and manufactured at low cost.

SUMMARY

This invention provides a an universal fluid control system in a fluid process station with simple, versatile vane actuator module and a thermal actuation system, the actuation system include at least one housing assembly, at least one dynamic porting system and at least one driver assembly, the housing assembly has a housing and top and a pair of top and bottom flange assemblies and at least one housing vane assembly, the drive assembly has at least one shaft vane assembly for generating output torque, the drive assembly has at least one pair of top and bottom removable covers placed on the van assemblies for securing joints between the shaft and shaft vanes with fasteners and create static seals, two internal corner seal rings and two external corner seal rings disposed respectively on groove of the shaft surface and grooves on a housing wall surface to provide corner seals between the shaft vanes and the housing vanes, each vanes has two edge grooves with two seal rings for providing seals among the covers, the housing vanes and the shaft vanes, the porting system has at least one of the porting link systems, which includes a radial porting system, axial porting system and central porting system, the shaft packing not only provides additional shaft seal, but also supports heavy shaft side load and control shaft motion stiffness based on various holding torques requirements. The thermal actuation system also includes three elements (1) pressure sources (2) volume vessels (3) heat sources and, it also can be powered by hydraulic or pneumatic sources to actuate the vane rotary movements.

Accordingly, besides objects and advantages of the present invention described in the above patent, several objects and advantages of the present invention are:

(a) To provide a fluid process station with at least one fluid control system, the fluid control system has a valve subsystem having a valve and an actuation system with the best components based on the solid fluid dynamics and the optimized system performances.

(b) To provide high sealable vane actuator, such an actuator can be used for highly precision volume or position control applications without leak.

(c) To provide a vane actuator without limitation of rotation and side loads, so the actuator can used for any rotary angle application between 0-360.

(d) To provide an actuator with controllable stiffness, so the actuator has an adjustable stiffness device for position holding applications, so the actuator can adaptor various applications with various stiffens efficiently unlike the conventional vane actuator which have no workable holding capability with no converting frication or helical actuators which have high unnecessary holding force and waste energy due to the high converting frication.

(e) To provide a reliable actuation system, so the system can conduct full stroke test without changing valve operation conditions unlike the partial stroke test, the partial stroke test miss critical part of the stroke which is either closed to full open or closed positions, so it is never reliable solution.

(f) To provide a actuator with multiple, dynamitic porting system, so the multiple porting vane actuator not only has evenly movements and loads for each vane, but also can provide various power sources for two or three dimension motion controls for higher reliable, complicated motion control applications.

(g) To provide a hybrid powered vane actuator, so both pneumatic and hydraulic powers can be used in one system, so the hydraulic vane provides the stiffness while pneumatic power provide pressure sources and fast actions, moreover powered air release without polluting water or air, or hydraulic power is broken down, the pneumatic power can be used or vice versa.

(h) To provide a highly efficient vane actuator, so the actuator has not only adjustable rotation and lager output torques with side load support, but also minimizes vane spaces and weight as well as releasing pressurized fluid and controllable stiffness for various loading toques applications.

(i) To provide a pressure protection system with pressure control actuators, so such a system can be equipped with regular full open and full closed valves with simple reliable control system at the low cost.

(j) To provide heating device for air reservoir, so the system can use less pressurized gas and reduce operation cost and increase reliability.

(k) To provide an actuation system with adaptable interfaces, so the actuators can be interconnected for 2D or 3D actuators and connected with various shaft joints without backlash or loss of motion for precision motion control.

Still further objects and advantages will become apparent from study of the following description and the accompanying drawings.

DRAWINGS

FIG. 32 is an ISO, quarter cut view of a fluid control system.

FIG. 33 is an ISO view of a thermal actuation section assembly of FIG. 32

FIG. 34 is a front view of the actuator module of the assembly of FIG. 33

FIG. 34*a* is a cross-sectional view of the actuator module assembly of FIG. 34 along line A-A.

FIG. 34*b* is a "C" detail view of valve of FIG. 34*a*.

FIG. 35 is a front view of fluid pad assembly of the assembly of FIG. 33.

FIG. 35*a* is a cross sectional view of the actuator module assembly of FIG. 34 along line B-B.

FIG. 35*b* is an ISO view of a shuttle of FIG. 35*a*.

DESCRIPTIONS

Figure 1:
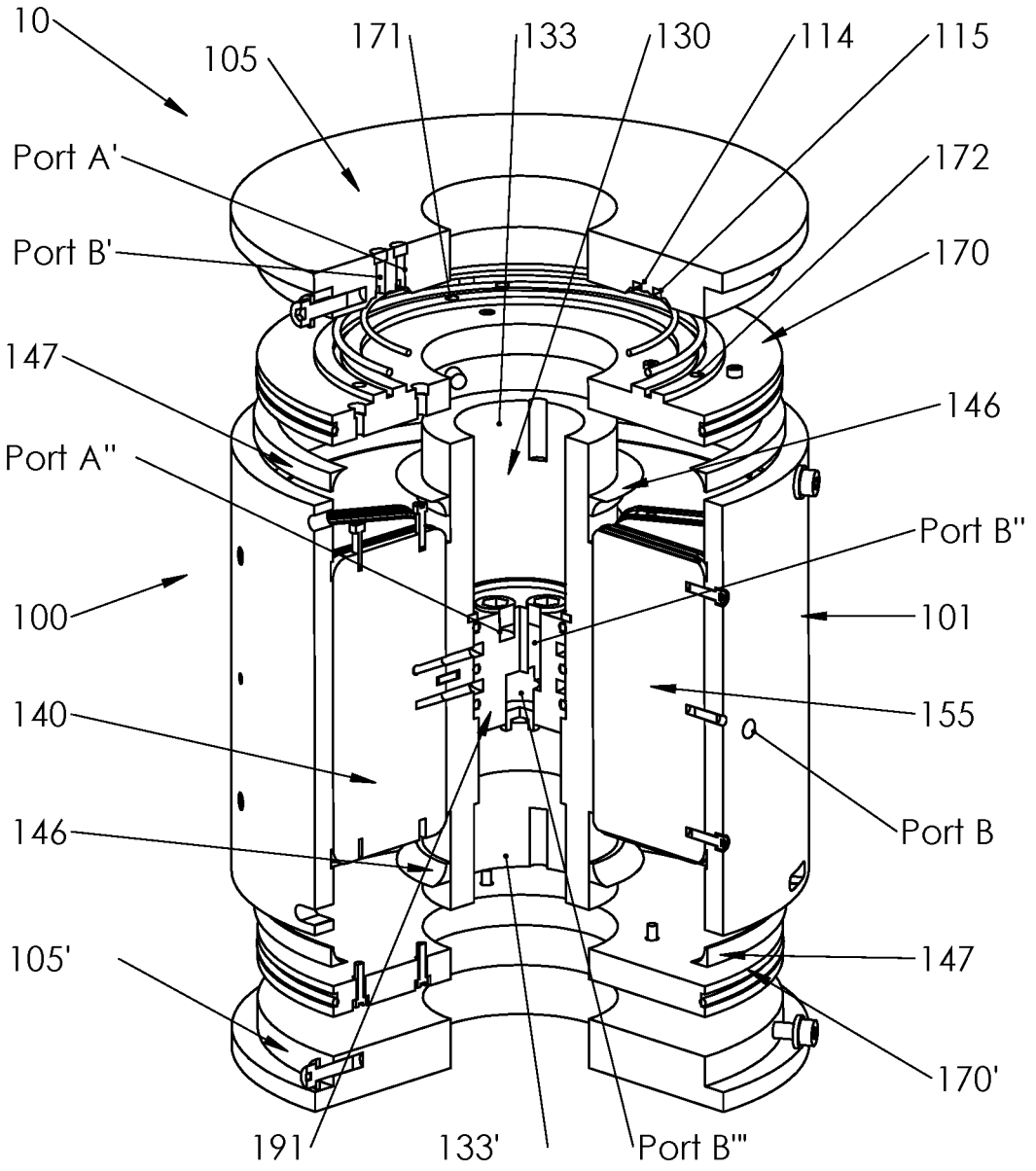
FIG. 1 is an exploded, quarter cut view of a vane actuator module constructed in accordance with this invention.
Figure 2:
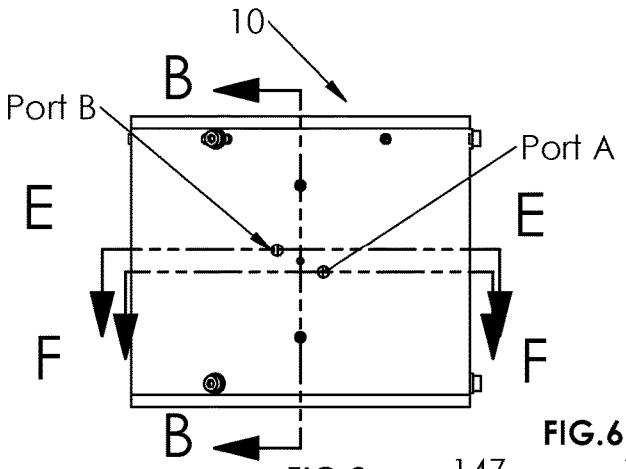
FIG. 2 is a front view of actuator. of FIG. 1
Figure 3:
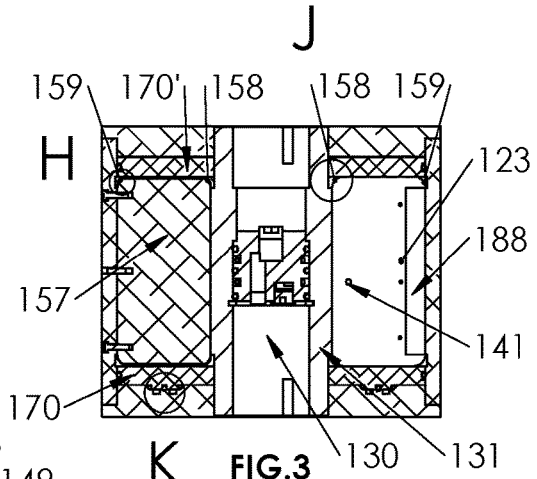
FIG. 3 is a cross sectional view of actuator of FIG. 2 along line B-B.
Figure 6:
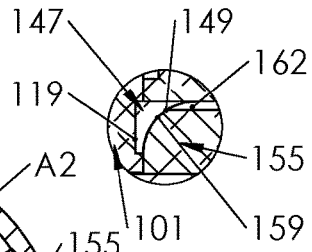
FIG. 6 is a "H" detail view of valve of FIG. 3
Figure 7:
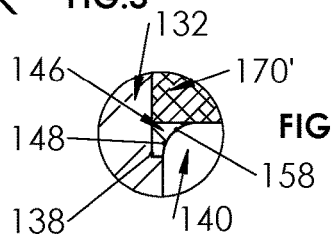
FIG. 7 is a "J" detail view of valve of FIG. 3
Figure 4:
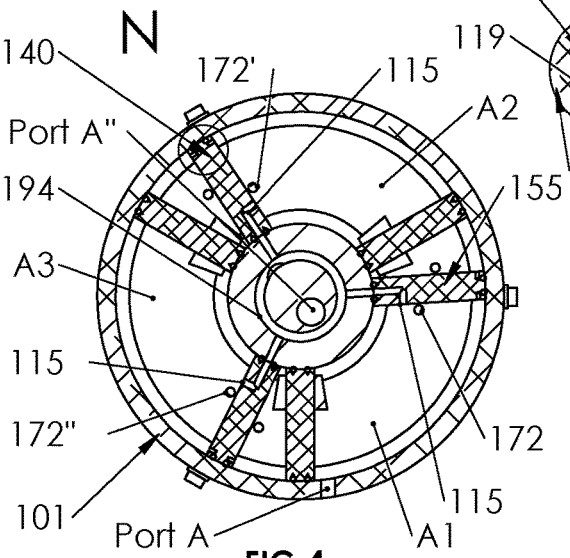
FIG. 4 is a cross sectional view of valve of FIG. 2 along line E-E.
Figure 5:
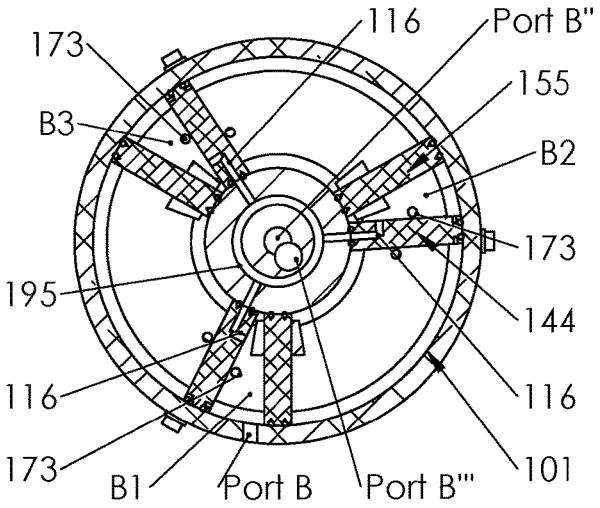
FIG. 5 is a cross sectional views of valve of FIG. 2 along line F-F.
Figure 8:
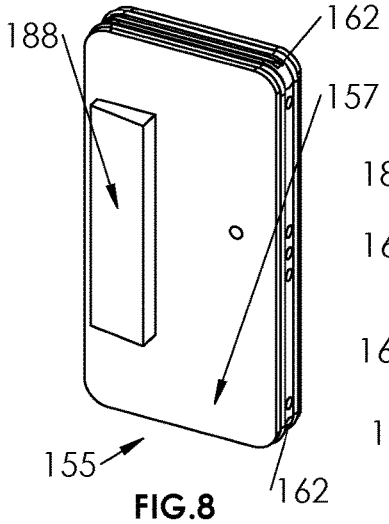
FIG. 8 is an ISO view of wall vane assembly of FIG. 3
Figure 9:
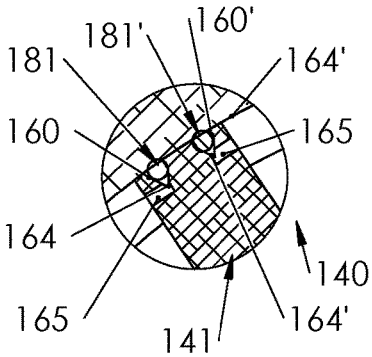
FIG. 9 is a "N" detail view of valve of FIG. 4.
Figure 10:
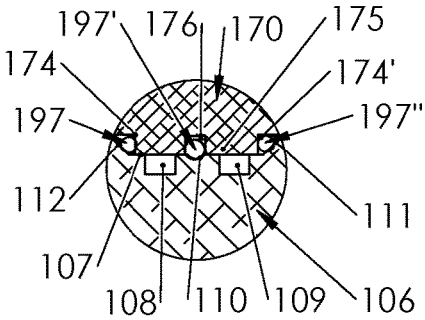
FIG. 10 is a "K" detail view of valve of FIG. 3
Figure 11:
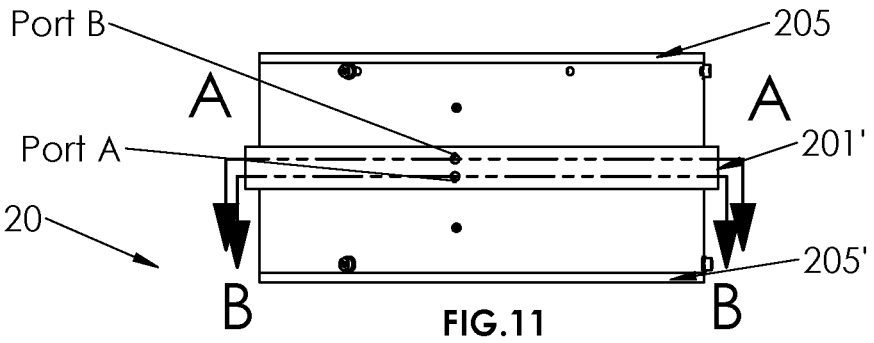
FIG. 11 is a front view of an alternative actuator module assembly of FIG. 1.
Figure 12:
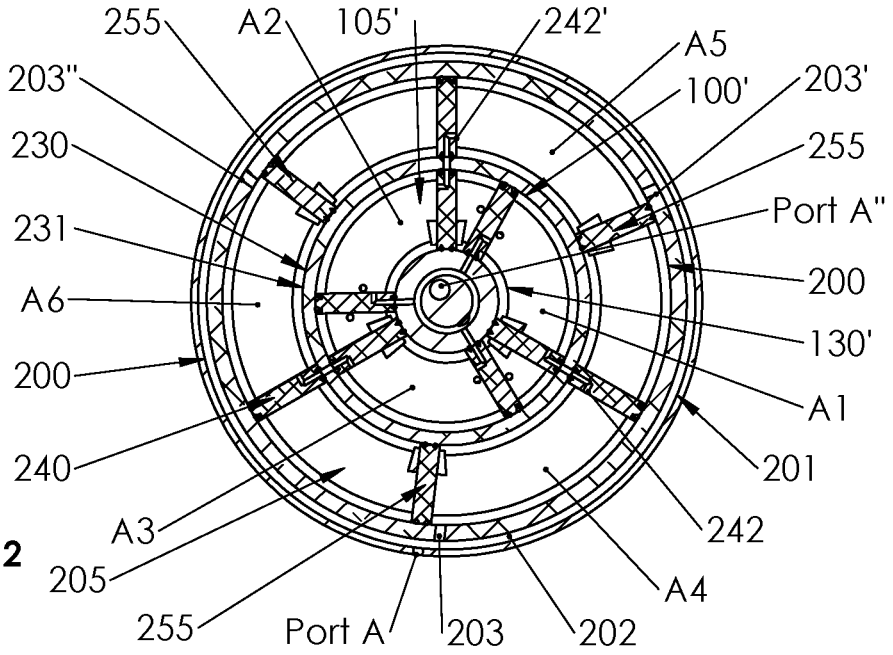
FIG. 12 is a cross sectional view of the actuator module assembly of FIG. 11 along line A-A.
Figure 13:
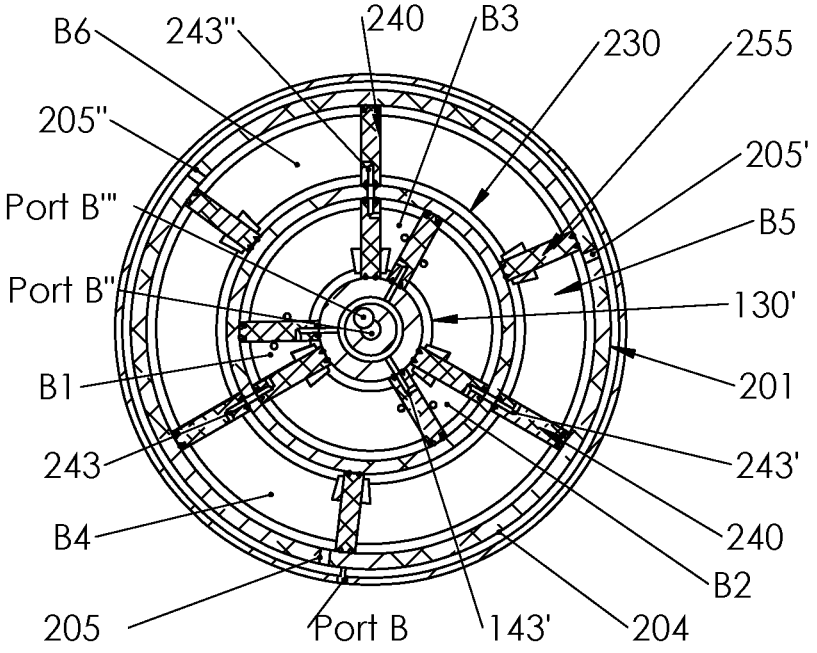
FIG. 13 is a cross sectional view of the actuator module assembly of FIG. 11 along line B-B.
Figure 14:
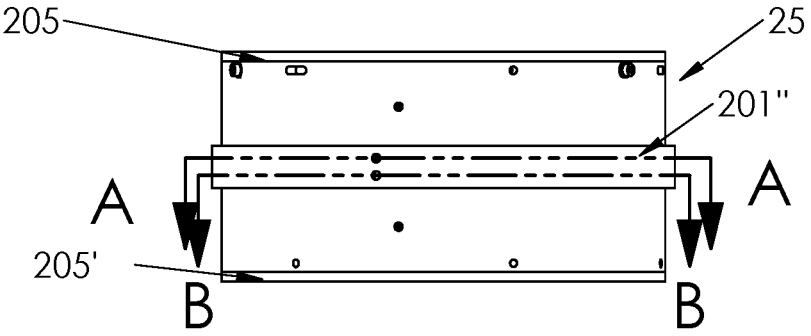
FIG. 14 is a front view of an alternative actuator module assembly of FIG. 11.
Figure 15:
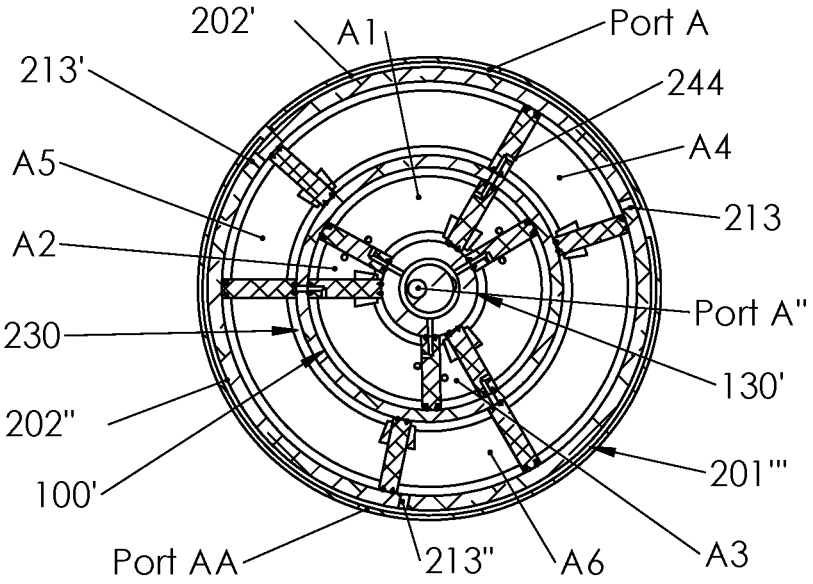
FIG. 15 is a cross sectional view of the actuator module assembly of FIG. 14 along line A-A.
Figure 16:
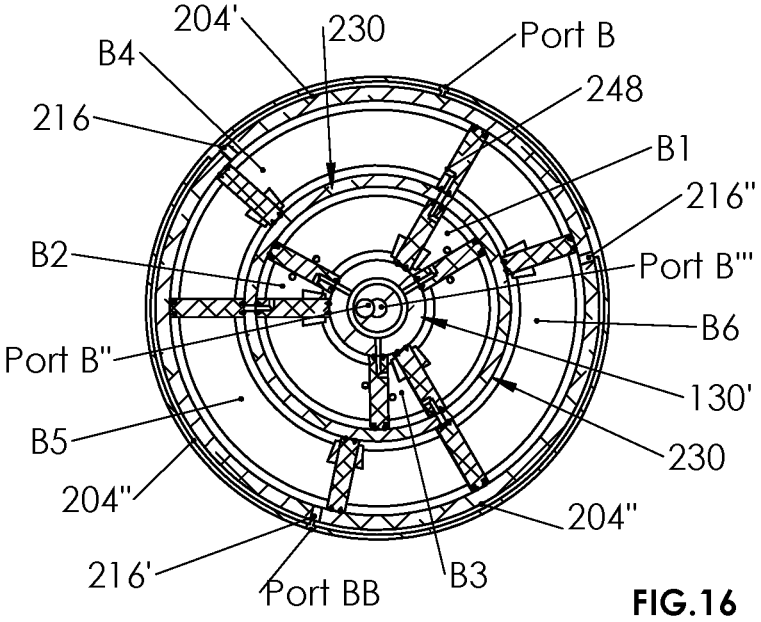
FIG. 16 is a cross sectional view of the actuator module assembly of FIG. 14 along line B-B.
Figure 17:
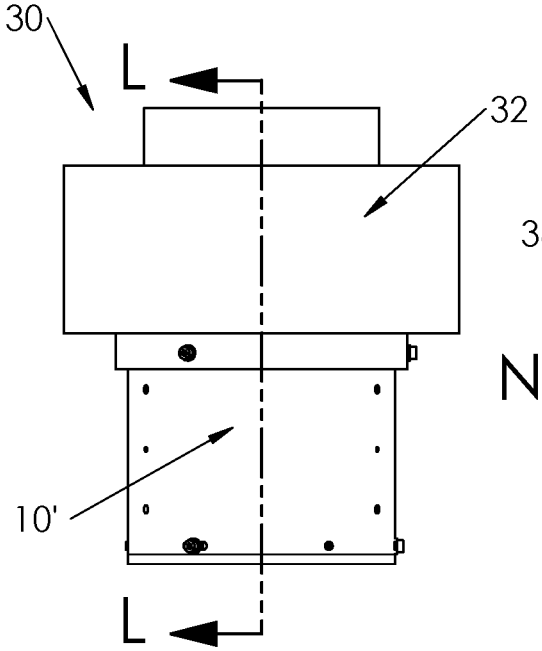
FIG. 17 is a front view of an alternative actuator module assembly of FIG. 1.
Figure 18:
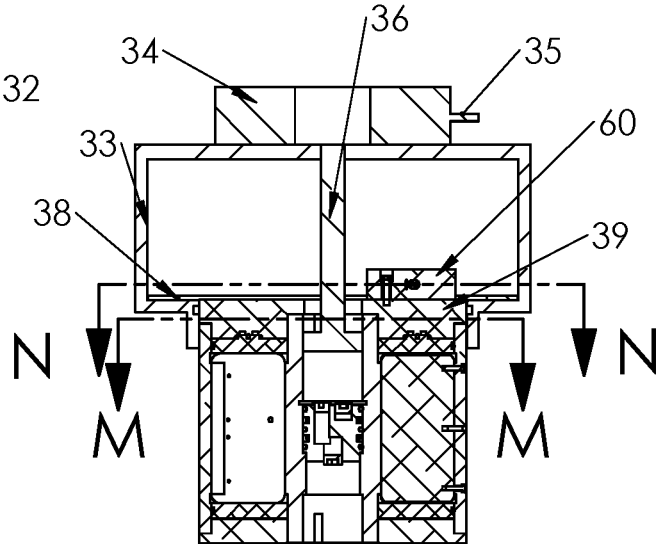
FIG. 18 is a cross sectional view of the actuator module assembly of FIG. 17 along line L-L.
Figure 19:
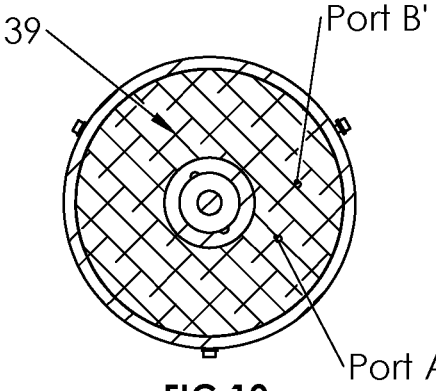
FIG. 19 is a cross sectional view of the actuator module assembly of FIG. 18 along line M-M.
Figure 22:
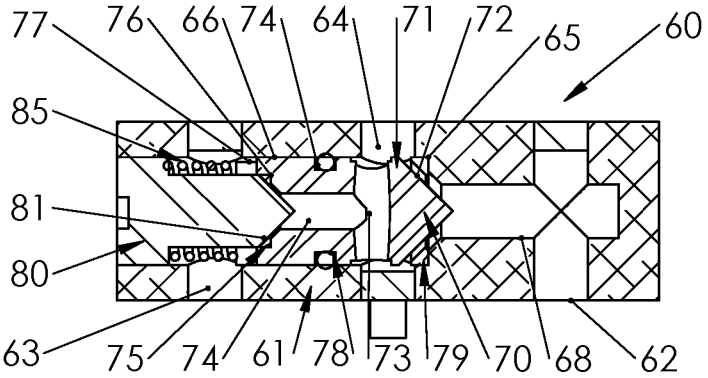
FIG. 22 is a cross sectional view of the actuator module assembly of FIG. 21 along line J-J.
Figure 21:
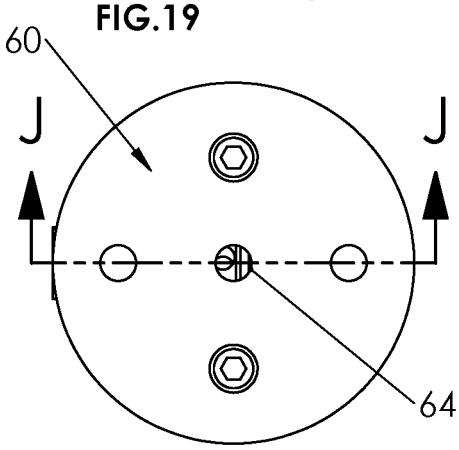
FIG. 21 is a top view of a shuttle valve of FIG. 18.
Figure 20:
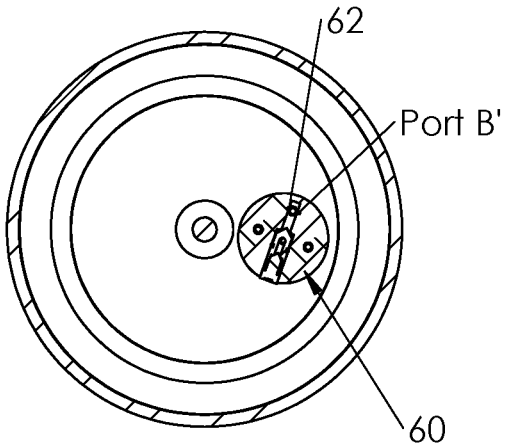
FIG. 20 is a cross sectional view of the actuator module assembly of FIG. 18 along line N-N.
Figure 23:
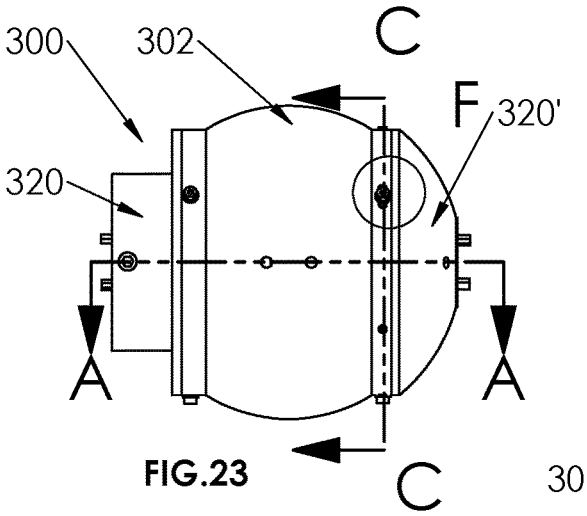
FIG. 23 is a front view of an alternative actuator module assembly of FIG. 1.
Figure 24:
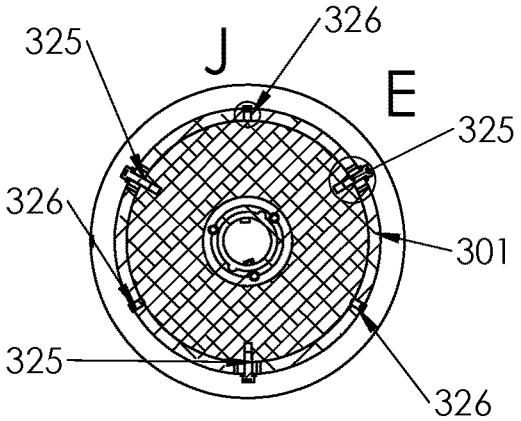
FIG. 24 is a cross sectional view of the actuator module assembly of FIG. 23 along line C-C.
Figure 26:
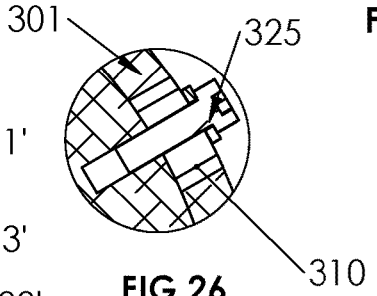
FIG. 26 is a "E" detail view of valve of FIG. 24.
Figure 27:
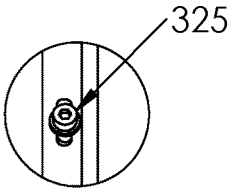
FIG. 27 is a "F" detail view of valve of FIG. 23.
Figure 25:
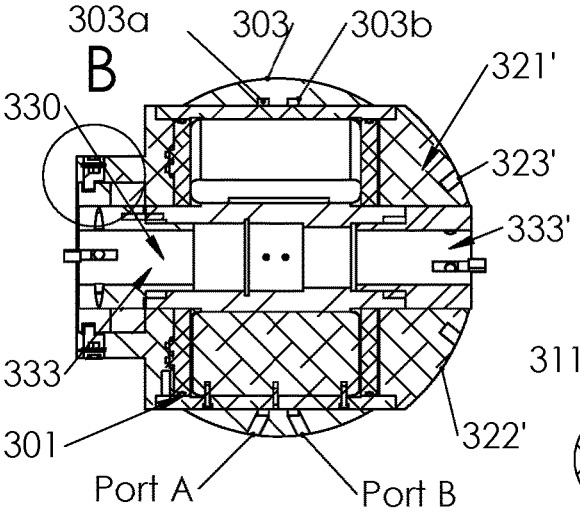
FIG. 25 is a cross sectional view of the actuator module assembly of FIG. 23 along line A-A.
Figure 28:
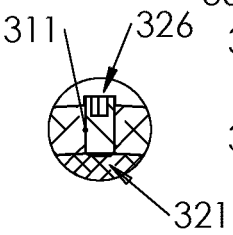
FIG. 28 is a "J" detail view of valve of FIG. 24
Figure 29:
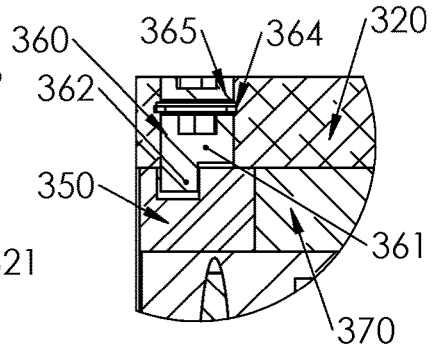
FIG. 29 is a "B" detail view of valve of FIG. 25
Figure 31:
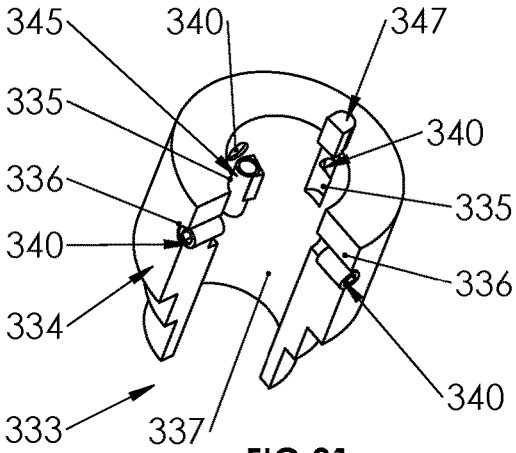
FIG. 31 is an ISO view of an quarter cut view of shaft adapter assembly of FIG. 29.
Figure 30:
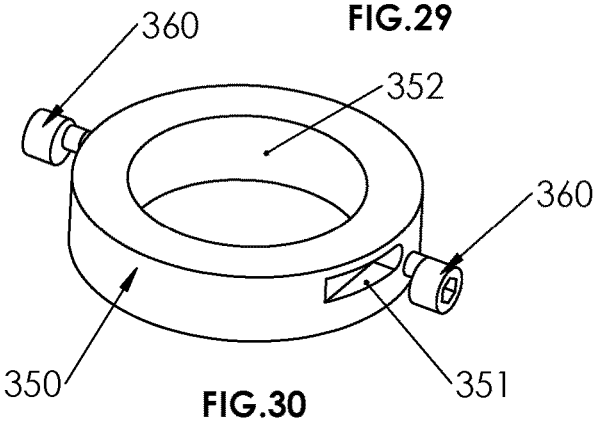
FIG. 30 is an ISO view of an adjustable packing bearing device of FIG. 29.

FIGS. 1 and 32 illustrate a vane actuator assembly 10 in a fluid control system 400 constructed in accordance with the present invention, the vane actuator assembly 10 has a first housing assembly 100, a fluid power porting system imbedded for delivering pressurized fluids and a first drive assembly 130 movably disposed in the first housing assembly 100, the first housing assembly 100 has a first housing 101, a first-up flange assembly 105 with a porting and a first-down flange assembly 105' without a porting and three housing vanes assemblies 155, the first drive assembly 130 has a pair of removable covers 170,170 installed on a bottom and top of three shaft vanes assemblies 140 respectively engaged with three housing vanes assemblies 155 for providing output torque by means of a top output adapter 133' and output adaptor 133'.

Referring FIGS. 1-10, the first drive assembly 130 has a shaft assembly 131, three shaft vanes assemblies 140 respectively fastened with shaft assembly 131 radially, a pair of top and bottom removable covers 170,170' respectively secured with top and bottom of the shaft vane assemblies 140 and movably engaged with the housing vane assemblies 155 and two internal corner seal rings 146 and two external corner seal rings 147, the shaft assembly 131 has a shaft 132, the output adapters 133,133' respectively installed on the top and bottom of the shaft assembly 131 as an integral unit or an assembly unit, three housing vanes assemblies 155 respectively engaged with shaft vane assemblies 140 for generating reactionary and active torques, the housing vanes assemblies 155 are installed with the housing 101 internally, a pair of top and bottom covers 170,170' secured with top and bottom of the shaft vane assemblies 140 and movably disposed on top and bottom of the housing vane assemblies 155, since shaft vanes assembly 140 and the housing vane assembly 155 have the similar features, so the common features are detailed here for both vanes assemblies 155 and 140, each of the housing vane assemblies 155 has two seal rings 181,181' and a housing vane 157 and two stop pads 188 to restrict absolute rotations between the shaft vane assembly 140 and the housing vane assembly 155, the housing vane 157 is defined by two internal radius surfaces 158, two external radius surfaces 159, two V seal grooves 160,160' constructed around an edge of the vane 157 respectively to receive seal rings 181,181' for separating the V seal grooves into two sections: an upper section 164 providing seals between the housing vane assembly 155 and shaft vane assemblies 140 and a down section 165 expanding to multiple like holes 165 for pressure energized seals, two pressure equalized grooves 162 are respectively constructed on a top and a bottom of the housing vane 157 for eliminating or minimizing crossover fluid leaks during rotation of the covers 170. 170', each of the shaft vane assembly 140 has two seal rings 181,181' and a shaft vane 144 with two seal rings 181,181' for providing seals like the housing vane assembly 155, the shaft vanes 144,157 are respectively defined by two internal radical surface 158 and two external radical surface 159, two grooves 138 are defined by the shaft 132, covers 170, 170', a shaft vane 141, each of the two internal corner seal rings 146 respectively disposed in groove 138 has a mated radical surface 148 engaged with radical surface 158 for providing internal corner seals, two grooves 119 are respectively defined by the covers 170, 170', the housing vane 155 and the housing 101, each of the two external corner seal rings 147 respectively disposed in the groove 119 has a mated radical surface 149 engaged with the radical surface 159 for providing external corner seals.

The porting system has a radical A/B porting system, an axial A'/B' porting system and a center A"/B", B"' porting system 191 having port A" and port B", port B"' with three plugs, retaining ring 109 and two top plugs blocked axial ports A', B', the porting system has a port line A having port A, port A', port A", three cavities A1,A2, A3 respectively defined by right sides of the housing vanes 155, left sides of the shaft vane assemblies 140, the shaft assembly 131, covers 170,170' and housing 101, the port A is connected to cavities A1, A2,A3 through holes 172,172', 172" of the cover 170 to groove 109 and to port A', the port A is connected to cavities A1,A2,A3 through three "L" passages 115 to groove 194 and to port A", the porting system has a port line B with a port B, port B', port B", port B"' and three cavities B1, B2, B3 respectively defined by left sides of the housing vane assemblies 155, right sides of the shaft vane assemblies 140, the shaft assembly 131, covers 170, 170' and the housing 101, the port B is connected to cavities B1, B2, B3 through three holes 173 of the cover 170 to groove 108 and to port B', the port B is connected to cavities B1, B2, B3 through three "L" passages 116 to groove 195 and to ports B" and B", the porting flange assembly 105 has a seal groove 107 defined by an internal conical surface 112 and an internal conical surface 111, a spherical groove 110, link grooves 108, 109, three seal rings 197,197',197", the cover 170 engaged with the seal groove 107 has steps 174,174' and a groove 176, two seal rings 197, 197" are respectively disposed between internal conical surface 112 and steps 174, between internal conical surface 111 and step 174' for dynamic and static seals between the porting flange assembly 105 and the cover 170, the seal ring 197' is disposed between the groove 110 and the groove 176 for providing dynamic and static seals between link grooves 108, 109, the center porting assembly 191 has a step 196 engaged with the drive assembly 130 and constricted by retaining ring 141, so the center porting assembly 191 can be used as dynamic port adapter even when the drive assembly 130 is rotated, a second drive assembly can be added axially as a turbocharge unit to take advantage of releasing pressurized fluid from port A or port B, because one port line A or B always has zero pressure, so such an operation would not result any slow down or high back pressure at the first drive assembly, the both shafts can be made out of one unit or an assembly unit in the first housing assembly, it can be added on other type of rotary actuators like rack and pinion, helical or scotch yoke actuators.

Referring FIGS. 1-13, a differential rotation module 20 has a second housing assembly 200 with an external porting ring assembly 201', a first drive assembly 130' for providing first rotations and a second drive assembly 230 is constructed with the first housing assembly 100' as one integral unit or as a two-module assembled unit, the second drive assembly 230 has a shaft assembly 231 for adding additional rotation over the internal rotation of the first drive assembly 130', disposed in the second housing assembly 200 for providing output torques along with the first drive assembly 130', the second housing assembly 200 has also two a second up-flange assembly 205 and second down-flange assembly 205 ' constructed respectively with the first up-flange assembly 105, and the first down flange assembly 105' as one integral unit or as a two-module assembled unit, three housing vane assemblies 255 respectively engaged with three shaft vanes assemblies 240 radially for generating external reactionary and active torques, the shaft vane assemblies 240 installed with the shaft assembly 231 externally are respectively engaged with three housing vanes assemblies 255 for providing external output torques.

The porting system has a port line A with the port A, port A' and port A", three cavities A4, A5, A6 respectively defined by right sides of the housing vane assemblies 255, left sides of the shaft vane assemblies 240, the port A is connected to cavities A4, A5,A6 through a link groove 202 of external porting assembly 201' and ports 203,203' and 203", the cavities A4, A5, A6 are respectively connected with the 130' drive assembly through three "Z" passages 242, 242', 242" constructed with a left L and a right L into cavities A1,A2,A3, the porting system also a port line B with a port B, port B', port B", port B"', three cavities B4, B5, B6 respectively defined by left sides of the housing vane assemblies 255, right sides the shaft vane assemblies 240, the port B is connected to cavities B4, B5, B6 through a link groove 204 of the link ring assembly 201 and ports 205,205' and 205", the cavities B4, B5,B6 respectively connected with the 130' drive assembly through three "Z" (Z is a combination of a left L and a right L shape) passages 243, 243',243" into cavities B1,B2,B3.

Referring FIGS. 11-16, a differential sequence module 25 is similar to module 20 only with a different posting system and has the second housing assembly 200 with an external porting ring assembly 201", a first drive assembly 130' for providing first output torques and a second drive assembly 230' disposed in the second housing assembly 200 for providing the second output torques clockwise or anti-clockwise after the first drive assembly 130' rotation, the second drive assembly 230 has a shaft assembly 231', two shaft vanes assemblies 240, one porting shaft vane assembly 240' and three wall vane assemblies 255, two shaft vanes assemblies 240, the one porting shaft vane assembly 240 respectively installed with the shaft assembly 231' radially and respectively engaged with three housing vanes assemblies 255 for generating output torques from the first drive assembly 130' then the second drive assembly 230', the housing vanes assemblies 255 are installed with the housing 201 internally for providing reactionary and active torques with the shaft vane assemblies 230', 230".

The porting system has a port line A with port AA, Port A, port A', port A", three cavities A4, A5, A6 respectively defined by right sides of the housing vanes 255, left sides of the shaft vane assemblies 240, the port A is connected to cavities A4 through a first section link groove 202' of the external porting 201" and a hole 213 and through "Z" passage 244 constructed with a left L and a right L into A1,A2 and A3 for actuating driving assembly 130' or releasing fluids, the porting system has also a line B with the port B subsystem has port BB, port B, port B', port B", port B"', three cavities B4,B5, B6 respectively defined by left sides of the housing vane assemblies 255, right sides the shaft vane assemblies 240, the port B is connected to cavities B4 through a link groove 204' of the link ring assembly 201' and through "Z" passage 248 constructed with a left L and a right L into B1, then B2, B3 for actuating drive assembly 130' or releasing fluids, the Port AA is connected with cavities A5, A6 through a section link groove 202" of the external porting assembly 201" and holes 213' 213", the Port BB is connected with cavities B5, B6 through a link groove 204' of the link ring assembly 201' and holes 216', 216", when Port A and Port B are used for actuating and releasing, cavities A5,A6, B5,B6 are not used, there is no power fluids in or out cavities A5, A6, B5, B6, so cavities A4 and B4 are used for porting purpose and would not drive the second drive assembly 230, only the first drive assembly 130' moves as the first rotation, then once port BB with coming fluids is connected to the cavities B5, B6 through holes 216' and 261" respectively and the port AA is connected to cavities A5, A6 through a section link groove 202" of the external porting assembly 201" and holes 213',2013", A4 is ready connected, the second drive assembly 230' would rotate, cavities A5,A6, B5,B6 are respectively connected to the Port A subsystem and port B subsystem, so the second drive assembly 230' can rotate independently with Port A and Port AA from the link ring assemble 201' and without "Z" (a left L and a right L shapes combination) passage 244, and with Port B and Port BB from the link ring assemble 201' and without "Z" passage 248, while the first drive assembly 130' can rotate independently with port A', port B" or from port A" and ports B" or B"', cavities A1, B1, A4, B4 can be used as independent control porting system for actuation or holding a position with liquid or gas.

Referring FIGS. 17-22, a thermal actuation system 30 has a vane actuator module 10' and an air reservoir assembly 32, the air reservoir assembly 32 has a shaft adaptor 36 disposed between actuator module 10' and the air reservoir assembly 32 for indicating the rotation position of vane actuator module 10' and a reservoir housing 33 disposed on the vane actuator module 10' by means of a porting cover assembly 170" for storing pressured air and a heat tracing 38 and a top hot gas heater exchanger 34 with an adaptor 35 for heating pressured air, the cover assembly 170" has ports A',B' and an internal shuttle valve 60 connected with ports A', B', the internal shuttle valve 60 has two positions; a front open/back closed and a front closed/back open, the internal shuttle valve 60 has a body 61, a shuttle assembly 70 and a back seat assembly 80 and a back seal ring assembly 75 against the back seat assembly 80, the body 61 has two bottom holes 62,63 respectively connected with Port A', B' and a release port 64 connected with the pressure vessel 33, as high pressure fluids come into port A and to port A' pushes the shuttle assembly 70 at the front open/back closed position, hole 62 is connected Part A' and block between hole 63 and port B', then the high pressure fluid flows into the air reservoir assembly 32 through port 64 and rotate module 10' clockwise or anti clock wide, once high pressure fluids become lower pressure or no fluid in fluid at Port A and Port A', the shuttle valve 60 moves back to the front closed/back open position, hole 62 from port A, and hole 64 are blocked, while the release port 64 is connected with hole 63, the pressurized fluid in air reservoir assembly 32 flows into port B' to rotate the model 10' anti-clockwise or clockwise as an air return instead of spring return (a solenoid valves open Port A and closed port B not shown), the body 61 has also a L shape sensing bore 68 expanding to the hole 62, a front seat step 65 and a link bore 73 linking to hole 74, the shuttle assembly 70 has a shuttle 71 and a seal ring 78 and a back seat 75, the shuttle 71 has a head 72 against the front seal ring 79 for seals and the L shape sensing bore 68 for sensing, the back adjustable seat assembly 80 has a spring 85 biased against shuttle 71 and the fluid pressures on the hole 68 for creating a preset pressure, the seal ring 78 disposed between the bore 66 and the shuttle 71 for generating piston effect against the spring 185, the shuttle 71 has a center hole 74 expanding to multiple side holes 73 and to and multiple back slots 77, the shuttle valve 60 can be used as a pressure regulator, the hole 63 as an inlet, the hole 64 as an outlet, the hole 62 as a sensing hole connected to the hole 64, as pressures in the hole 68 increase, the shuttle 70 moves to block the hole 63, then pressures in the holes 68, 62 reduce to zero without the fluid, the spring 85 push back, shuttle 70 block path between hole 68 and 64, in short, there are four shapes of sensing bores, the straight I shape, a right angle shape, according to the T shape and the L shape, as the solid-fluid dynamics and the test related to this invention show that, the best shapes for sensing is the T shape which provides sufficient fluids and length for conditioning and for accurate sensing, the L is the second, the I shape is the third, the reason is the fluid supply restricted by the inlet tube with conditioning, the right angle type is the worst with a turbulent or unstable chamber, the relief port 63 has the similar types, but one unique issue is relief port 63 reaction force, which can cause most of damage of the plug, poppet, shuttles and leakage, so the relief groove is connected between the shuttle and relief port to avoid direct reaction forces on the shuttle, so as a part of the power sources (heat, pressure and volume), the hot gas heat exchanger 34 disrupted the current direct natural gas power system by burning the gas to increase compression air gas to power actuator 10' instead by using natural gas as a pneumatic source to power the actuator module 10', the current direct natural gas pneumatic power systems are widely used for the gas pipelines in north American, Russia and China, it is cheap and simple without additional pneumatic power sources, but not only wastes gas energy in each cycle of the operations, but also increase risk of fire explosion between gas source and the pressure barrier device (the shutoff valve) and cause the air pollution along with the gas pipelines, in addition the gas companies are faced with more legal and regulation challenges, even for crude oil pipelines, some gas content <20% in total oil volume cannot be used as pneumatic power source, but can be used for heat tracing energy by a hot gas heat exchanger to warmer the oil in the pipeline for transportation as well as for the actuation.

Referring FIGS. 1-3, 23-31, if the flange assembly 105 is assembled with the cover 170 with a corner seal ring 147, while the flange assembly 105' assembled with the housing 101 as a pair of a stator and a rotor, then the vane actuator module 10 would be functioned as a fluid-powered hinge or helical rotary actuator, and if both the flange assemblies 105, 105' are respectively assembled with both covers 170,170' with two corner seal rings 147 against the housing 101' as a pair of a stator and a rotor, then the vane actuator module 10 is functioned as a symmetrical fluid powered hinge, they are used for material handling, truck https://www.youtube.com/watch?v=gMHDYw06Z0E and trailer other places, as further improvements, an universally adaptable vane actuator module 300 is constructed to meet heavy load and hazard condition challenges and match with the helical rotary actuator performances, the vane actuator has a flange assembly 321', a housing assembly 301 and a drive assembly 330, the housing assembly 301 has a port linked ring 302 with Port A, port B having a spherical surface 303 for supporting the actuator 300 vertically with heavy weights of machinery like the excavator center compartment or combining with a second or third vane actuators 300 with fluid porting connections for 2 D or 3 D motion operations, the flange assembly 321' has a spherical interface 323' for supporting side loads from vane shaft adapter 330 when the actuator module 300 is installed horizontally, the flange assembly 321 and the housing assembly 301 have three screw/washer sets 310 for relative position adjustments between the flange assembly 321 and the housing assembly 301 and three setscrew 315 set with high frication structures on the flange assembly 321' for locking the relative position adjustments, the housing assembly 301 has three slots 307 to receive the screw sets 310 for adjusting a relative position for +/−15 degrees or more, the drive assembly 330 has a shaft adapter assembly 333 having three external cylindrical slots 333 for coupling with the drive assembly 330 with three pins (not shown), so the drive assembly 330 can be coupled with various shafts joints without changing whole vane actuators 300, the shaft adapter assembly 333 has also three internal pin slots 355 coupled with output drive shafts and three pins (not shown) for pin/key shaft joints with pin 345 and key adapter 347, so if a shaft comes with a pin slot joint, the pins 345 would be used, if a shaft comes a key way joint, the key adapt 347 and pin 345 would be used, the shaft adapter assembly 333 has also three setscrews 340 respectively disposed in the holes 336 for a double D joint or square head shaft joints, finally adaptable vane actuator module 300 has a packing assembly 320, the packing assembly 320 has a lock bearing assembly 350 and a packing 370, the lock bearing assembly 350 has two horizontal slots 351 and two eccentric plugs 360, the eccentric plugs 360 has a driving cylinder 316 disposed in the housing assembly 301 and eccentric cylinder 362 engaged with the slot 351, when the driving cylinder 316 rotates, the eccentric cylinder 362 would push the lock bearing assembly 350 up and down against the packing 370 for adjusting frictions against the drive assembly 330, a retainer ring 364 and a setscrew 365 are installed for preventing the eccentric lock plug 343 from falling out, as a part of the drive train, the adaptors play a key role for the system performances, but a bad adaptor can cause many problems which include misalignments between valves and actuators, low transfer efficiency, loss of motion and premature shaft packing failure.

Referring FIG. 32-35*b* a fluid control system 400, the system 400 has a right valve subsystem 425' and a left valve subsystem 425, and a front access section 410 and two back access sections 420', 420", the front access section 410 has two sensing ports 412, the left valve subsystem 425 has a power supplier 434, an actuation-control section assembly 430, a normally closed valve 429 coupled with the actuation-control section assembly 430 for controlling flows between the front access section 410 and the back access sections 420' with one of the sensing port of the two sensing ports 412 through a tubing 436*b*, the right valve subsystem 425' has the actuation-control section assembly 430, a normally open valve 429' coupled with the actuation-control section assembly 430 for controlling flows between the front access section 410 and the back access sections 420" with one of the sensing port of the two sensing ports 412 through the tubing 436*b*.

Referring FIGS. 33-35*b*, the actuation-control section assembly 430 has a power supply assembly 434, the van actuation module 30 and a control chamber assembly 440 with a safety valve 437 for on-land applications and, the power supply assembly 434 has the gas-burned heat exchanger 34, a compressor 435 having a gas pressurizer 435*a* and a center air reservoir 435*b* or an external power supplier for providing fluid conditioning, a fluid pad assembly 460 through tubing 195 for supplying fluid powers, the van actuator module 30 has the Port A and Port B, a fluid pad assembly 460 has a fluid pad 461*b* with an link port A and a link port B respectively connected to the Port A and Port B, an intake shuttle valve 461 connected to the Port A and Port B through the link port A and the link port B through holes 478, 474 and a relief port 476, as an integral or separated part, the port A is connected with the power supply assembly 435 through the tubing 436*a*, the intake shuttle valve 461 has a front closed/back open position under low pressures or no pressure of the fluids from port A, a front open/back open position under high pressures of the fluids from the port A to control the internal shuttle valve 60 through the port line A and the port line B, the internal shuttle valve 60 has the front closed/back open position under low or no pressures and a front open/back closed position under high pressures, when high pressurized fluid from power supply 434 flows into hole 478, the Port A and push the intake shuttle valve 461 to the front open/back open position, the pressurized fluids get into the port line A, cavities A1, A2, A3 for actuating the van actuation module 30 and flow into the air reservoir assembly 32, while fluids in the cavities B1, B2, B3 are releasing through the port line B, and pass to the intake shuttle valve 461 through hole 476 to release to outside, when the high pressurized gas against line pressures fluid from sensing section 421 is reaching at a preset limit, the center shuttle valve 445 is releasing the actuation fluid under subsea applications or the safety valve 437 is open in land applications, the pressure in the tubing 436*c* comes near zero, the intake shuttle valve 461 moves back at a front closed/back open position, the hole 474 and the hole 476 are blocked to the port B, the internal shuttle valve 60 moves back to a front closed/back open position, so the hole 64 is disconnected with bore 68 and the hole 62, hole 64 are respectively connected with hole 63 and bore 74, so the pressurized fluid in the air reservoir assembly 32 flows into cavities B1,B2,B3 and the van actuator 30 rotates as a function of air return instead of conventional spring return, while a three-way solenoid valve (not shown) may be used on the fluid pad assembly 460 with the internal shuttle valve 60 for the same function.

Referring FIGS. 34-34*b*, the control chamber assembly 440 has a control housing 443 and a control piston assembly 441 movably disposed in the housing 443 separating the housing 443 into an active cavity 444*a* and a sensing cavity 444*b* the housing 443 has a large bore 443*a* and a small bore 443*b*, the inlet sensing port 436 *c*, an outlet port 442, the piston assembly 441 has a boss ring 446 to block the outlet 435*c* as a Deadman's switch in case high pressure in the active cavity 444*b* reaches a preset condition without electricity, the piston assembly 441 has a "I" straight pattern sensing bore 445*a* expanding to a bore 445, a large OD 446*a* engaged with the large bore 443*a* and a small OD 446*b* engaged with the small bore 443*b* for sensing and balancing pressures between cavity 444*a* and cavity 444*b* by a preset ratio between an area of the large bore 443*a* and an area of the small bore 443*b*, the cavity 444*b* has a pressure sensor 437*a* and the pressure safety release valve 437 for sensing and releasing pressures in cavity 444*a* when the pressures in cavity 444*b* reach a preset pressure, the piston assembly 441 has a shuttle 451 as an integral part or as a separated valve 450 disposed in the bore 445 for releasing over pressures with multiple releasing ports 448 and a link groove 448*a* for releasing flows without causing cavitation and for protecting a shuttle 451 from reactionary force of relief fluid, which is major cause of leak and jamming for right angle pop valves, the piston assembly 441 has a front seal ring 457, a back adjustable seat assembly 456 and, a spring 459 biased between the shuttle 451 and the back adjustable seat assembly 456, the shuttle-151*a* has a center hole 451*a* extending to multiple radial holes 451*b* as at least one set of three holes 451*b* to create three fluid streams balances as well as three equal fluid force balances on the shuttle 451 to center the shuttle 451, and a head 453 having a sensing section 453*a* against the sensing bore 445*a* for sensing pressures in the cavity 444*a* and a seal section 453*b* against the seal ring 457 for front seals and the head 453 can be constructed with an extended tip like intake shuttle valve 461 and acts like a limit switch as well when the piston assembly 441 moves up and down in the active cavity 444*a*, the sensing section 435*b* against the sensing bore 445*a* to form a hybrid sensing mechanism, a profile of the sensing section 435*a* is very critical for sensing accuracy, stable dynamic performances, and has a concave profiles with a conical profile, a spherical profile and a cylinder profile, and the combinations and flat profiles and convex profiles like a conical bore, counter bore, a spherical bore and the combinations, other factor is the flow medium with liquid or gas, a test conducted for this invention indicates that at low pressure <200 psi, there is no significant differences with any profiles between gas and liquid applications, but once the pressures increase, the gas and liquid behave much differently, the following results are shown for the best static and dynamic performances with this hybrid sensing mechanism, for pressure relief valves, and check valves, regulators, directional control valve in the liquid applications, the concave profiles should be used, while for the pressure relief valves, and check valves, regulators, directional control valve in the gas applications, the convex profiles should be used, the flat profile is used for hybrid applications with liquid and gas.

Referring FIGS. 35-35*b*, the intake shuttle valve 461 has a body 461 *a* having a bore 464 expanding to a T shape sensing bore 464*a*, the hole 145, a shuttle 464 movably disposed in the bore 464, a front seal ring 470 disposed in a front of the bore 464, a back adjustable seat assembly 472 and a back seal ring assembly 477 disposed between the shuttle 464 and the back adjustable seat assembly 472 for seals, a spring 471 biased between the shuttle 464 and the back adjustable seat assembly 472 for creating a preset pressure, the shuttle 464 has a head 465 having a sensing section 465*a* against the sensing bore 464*a* and the seal section 465*b* against the front seal ring 470, the head 465 can be made out of magnetic materials against a peripheral of the sensing bore 154*a* to provide a short distance seal force, a center hole 464*a* expanding to multiple side holes 464*b* as three holes 464*b* as a set to create three equal fluid streams balances as well as three equal fluid forces balances on the shuttle 464 to center the shuttle 464 and to prevent it from rubbing and rotating a link groove 468 between center hole 464*a* and the shuttle 464 and multiple back slots 473 for releasing flows without cavitation damages, the sensing section 465*a* has a groove 465*a* to receive a seal ring 473 for creating full piston effect between front pressures and the spring 471, the seal section 465*b* against the front seal 470 for seals between the hole 476 and the bole 474 through the center hole 464*a*, the shuttle 464 with the extended tip 465*a* can be actuated by pressures or a manual, magnetic force or stopped by a hard stop, the body 461*a* has three holes 478, 474 and 476 respectively connected to the Port A, Port B and outside, the shuttle valve 461 can be used as a pressure regulator with the hole 474 as an inlet, the hole 476 as an outlet, the hole 478 as a sensing port connected with each other as a pressure in the hole 476 increase and push the shuttle 464 up and block the hole 474 against the spring 471, then the pressure in port 478 reduces, the spring 471 would push the shuttle 464 back, then the hole 474 opens again, because it have the piston effect, the regulation performance become much better and stable. finally the two internal shuttle valves 461 are constructed as a counter-balanced valve, a first of the two valves 461 has the hole 478 connected to the hole 474 of a second of the valve 461, a second of the two valves 461 has the hole 478 connected to the hole 474 of the of the valve 461, the counter balanced valve is used in hydraulic systems working with overriding (running-away) or suspended load and is designed to create backpressure at the return line of the actuator to prevent losing control over the load, in short, there are four types of sensing bores, the straight I type, a right angle type, according to the T shape and the L shape, as the solid-fluid dynamics and the test related to this invention show that, the best shape for sensing is the T shape which provides sufficient fluids and a length for conditioning and accurate sensing, the L shape is the second, the I type is the third, the reason is the fluid supply restricted by the inlet tube with conditioning, the right angle type is the worst with a turbulent or unstable chamber, the relief port has the similar types, but one unique issue is relief port reaction force, which can cause most of damage of the plug, poppet, shuttles and leakage, so the relief groove is connected between the shuttle and relief port to avoid direct reaction forces on the shuttle.

CONCLUSIONS

The present invention provides a comprehensive solution—how to balance between a system performance and each component performance for a fluid control system, here is the solution with the drive train optimizer and the energy spectrum distributer and the solid fluid metrics, the drive train optimizer is based on the best performance on the each link from valve, actuator, joint and to optimize each link of the train at the system level with energy consumption, efficiency and choice of forms; the hot gas heater exchanger, self-sustainable compressive gas and air reservoir and heat tracing with the energy spectrum distributer, finally the soli-fluid metrics and the descriptive design method revolutionize the fluid control system design process, and list all weakness of the fluid power system intern of seal/leak, chatter and pressure oscillation, cavitation, improve the shuttle valve performances with the sensing mechanism, the sensing mechanism with profile design and shape.

In the solid-fluid interaction, the five features are the most important for the van actuator performance as well as other challenges for seal applications, they are based on the solid-fluid dynamics a cutting edge tool developed by Fluid dynamics system LLC for solving the complicated fluid related problems in a systematic way that no one did before in the prior arts or the related history and related tests on the van actuation system from the root causes unlike any other solution or prior art, an inherent high leakage at corners as well as top and bottom faces of the vanes actuators the solution are (1) the removable top and bottom vane covers are designed to change the dynamic seals between the shaft vanes and housing flanges to static seals between shaft vanes and the covers to eliminate any dynamic leaks on the shaft and provides easy assembly and increase shaft vanes strength with top and bottom cover supports and reduce the housing weights by removing bolting holes on the housing (2) corner seal rings and two O rings in the V grooves provides a breakthrough inter mating dynamic seals with multiple redundancy instead of avoiding the corner seal issue, here is the expert review http://blog.parker.com/race-track-grooves%3A-can-o-rings-be-used-in-non-circular-groove-patterns, Ideal design: r>6×W diameter but no less than r>3×W diameter, but why the corner seal is so challenging, what is the root cause, no answer, but this application provide a break through solutions based on the solid-fluid dynamics and validated tests, the two external corner seal rings, and two internal corner seal rings along with two edge V grooves filled with two O ring seals for providing five redundant corner seals, the three metal (hard) surfaces of the van against the PTFE or PEEK rigid seal rings and PTFE and PEEK rigid rings against the two rubber flexible O rings, made out of the thermal polymer plastics provide evenly compressed sealing surfaces to each corner of the vanes, stationery wall vanes, rotational shaft vanes (3) the vanes with two complete circumference seal rings and each comers with complete circumference seal rings, this feature not only greatly reduce cost unlike conventional single vane actuator with multiple layer molded seals, but also increase the integrity of seal, reduce the seal rings wear out specially for high cycle operation, or high temperature condition due to thermal expansion (4) top and bottom pressure equalized grooves on the housing vanes with sealant for gas applications and no sealant for liquid applications, so the grooves catch crossover fluid due to various linear speed and eliminate leaks due to pressure gradients during the vanes are rotating, those features make the vane actuator possible to compete with the other rotary actuators like rack pinion or helical actuates for precision positions control at much low cost and much high reliability with a one moving part without linear and rotary motion converting, the feature can be used for linear shaft dynamic seals (5) both side pressure energized seals on the V grooves is much superior over square groove due to triangle stability and provide three chambers to prevent seal rings from extrusion and up-ups and three seal surfaces for the first time, it not only greatly improve dynamic seal performance and increase life of seal rings but also reduce the seal wearing with a pressure energized seal and interference seal. but also add redundant seals and pressure energized seals to prolong the seal ring life and increase the holding toque, the pressure still help provides good seals, the sealing is not only based on the interference but also the working pressure, the unique combination complete solves the century old problems for all vane actuators with much lower cost and much high reliability over all prior arts or all existing vane actuators around the world, moreover the vane can be constructed with control able magnetic property, so each of housing vanes is constructed as N pole, while each of the shaft vanes is constructed with S pole.

The universal adaptability of the vane actuator as a result of the drive train optimized is another breakthrough for the wide range of applications in the drive train, the spherical or conical flanges or housing joint would greatly increase holding capacity in any position like robotic 3 Dimensional or 2D motion actuators, three actuation modules would create a simple 3D robotic arm for replacing 16 linkages excavator control system, the satellite receiver or wind turbine control system, or weapon/heavy machinery system control, moreover the adaptability of the shaft joint for almost all ISO5211 connection selections or three pin joint is so universal that it can couple with any valve shaft joint like double D, key joint and square joint without an additional adapter, the adapter has the reliability and robustness of the joint and reduce possible of joint failure without backlash or loss of motion with various pins like dowel pin, coiled pins and spring pins or with pin with a preset strength as a safety device, if the load is reach the limit, the pin would be broken down for saving the actuator or driving objects or twisted as energy storing device to absorb the shock energy for most sudden closing operations along with the stop pads.

The differential rotation mechanism is other disruptive innovation, it breaks the limitation of rotation beyond 360 degree for the first time in history of the vane actuator, although the vane actuators is one of the oldest rotary actuators, the differential rotation mechanism put the vane actuator at the same capability level as the rack/pinion actuator or helical actuator but at much lower cost, each set of the drive assemblies will add additional rotation angles 90 or more for applications of diverting three way ball valves with 90 degree and 180 degree without any positioner control, 180, 270 and 360 degree are no longer be constrained for vane actuators, unlike rack pinion or helical actuators which would be bigger and larger due to the linear/rotary converting mechanism get more larger and heavier, as the angle increases, each set of the drive assemblies is disposed in concentric manner, balanced radially from the center axial to outward and can be constructed with the housing assembly with one level down as one integral unit or a two modules assembled unit, each drive assembly is well interconnected with others in item of porting and structures without additional tubing or parts, the foundational difference is the each of drive assemblies to create a relative rotation movement from prior one, they can be control by each independent porting system or by one combined porting system, those features greatly open the control field for more complicated applications which are impossible for most rotary actuators, the full stroke actuator test is impossible to conduct in any existing rotary actuator without affect valve operation condition, so instead the partial stroke test was introduced, the partial stroke test is a fault test but the best fault test with current actuation technology, the full stroke test is conducted with two set drive vanes with 90 degree rotation, if each drive subassembly is controlled independently, if first one rotate +90 degree, the second one rotates −90, the result is 90−90=0, even a valve operation condition does not change, the actuator is fully tested between 0-90 degree, other application is 90+90=180 degree rotation, two of the conventional vane actuators are constructed with an additional tubing, adapters and fixtures, big misalignment, but the differential rotation mechanism can accomplish the work with two drive subassemblies controlled to create a relative rotation, 90+90=180, for fast operation, if each drive sub assembly rotates 45 degree, 45+45=90 for open operations or 45−45=0 for closed operations, it takes a half time in comparison with the all conventional rotary actuator, it can finally compete against helical actuators in term of structure integrity and simplicity as well as cost.

The porting system is other innovation for four versatile porting systems ever developed for complicated actuation applications, the sealing rings and the differential rotation mechanism and the multiple porting systems are the three pillars for the 21 first century vane actuation, they work together to break all inherent barrier and to overcome difficulty of the challenging applications, it includes the axial porting subsystem, the center porting system and radial porting system, they can work together as redundancy or as an individual system, the axial porting subsystem provides a compact, dynamic porting method between the flange assembly and the cover unlike the conventional axial porting subsystem which are static porting system, it is well used for air return reservoir without external tuning or bolts and also is an important porting system for inter-porting among actuation modules for 2 D or 3 D motion control, as well as for top and bottom fluid entry applications, moreover the porting system can be an integral of the cover with press fit or glue for internal fluid connection among the cavities, while radial porting subsystem or the axial porting subsystem is a key element of the differential rotation mechanism in the sequence control applications, it includes the novel L passes between the vane assemblies, finally the center porting subsystem is other one for both static and dynamic porting applications, when the housing assembly is moving, the drive assembly is stationed for applications like earth moving equipment and landing gears or just internal fluid connection among the cavities, finally the porting line can be double or triples or more like porting lines C, D, E, and F for the speech control, like fast closing operation less than 1 second, three or more porting lines may be used at beginning, only a port line may be used at near closing position, so such a control not only solve the speech issue, but also avoid high closing impact which is the main reason for the seat and packing damage of most fast shut off valves, with a second axial drive assembly as a turbocharger, almost 50% of releasing pressurized fluid from line port A or line port B can add more torque to drive the output shaft of any types of rotary actuators, so if it is used for air returner applications, the actuators work like a double acting actuator, both side actuations have the same output torques as well function like a fan to protect the actuator in high temperature applications by depleting the heat, moreover, it can be used to hold a position by blocking both port lines A and B.

For first time, a separation between the relative position adjustment mechanism and the conventional absolute position adjustment as a result of drive train optimized is other disruptive innovation in this invention, most manufacturers or prior acts never even realize the difference between those two, this position adjustments for actuation system in this invention is divided into an absolute position adjustment and relative position adjustment, the conventional positions adjustment is based on an absolution position change between 0-90 or more, while for most operators in the field, a precision closed position is critical for all rotary valve, even 1 degree off can cause leak, but 99% of stem position adjustments are about the stem relative position to the joint flanges bolt holes with no need to alter a factory preset range 0-90 or 180+/−0.5 degree, only 1% of the actuation adjustments is an absolute adjustment between 0-90 or 180+/−5 or 10 degree, the relative positions adjustment is a simple solution to 99% problems, for further position security, anti-loosening washers or semi-permanent adhesive may be added with the bolts after setting a correct position, for 1% problems, the factory set 90+/−0.5 can be set at the factory with the stop pads, it along saves 60% time in most rotary actuations field calibration, moreover, the setscrews with high friction devices are used to secure a position between the flange and the drive assembly after adjustment as a redundancy beside the fastens, while the absolution position device is constructed with stop pads with the composite materials to absorb shock once they contact with each other, they are made at a preset angle in a factory with high precisions, in addition, the flange assembly and the cover together greatly reduce the housing materials without the thick wall for vertical bolting design as well as the shaft vane materials with think wall due to the cover reinforcement on the drive assembly and they make possible for the relative position adjustment, all the vane flanges in the prior arts are fixed not adjustable, the flange can be equipped with additional static seal rings for the housing assembly as a redundant seal, while the cover can be equipped with additional dynamic seal rings for the drivel assembly as a redundant seal.

The adjustable, inclusive, embedded shaft packing is other innovation with wide applications, first it not only provides additional shaft seals, but also increases the shaft side loading capacity by shifting the loading from the vane shaft to the packing area when the actuators installed in horizontal positions or between vertical and horizontal positions and controls precision rotation holding capacity based on various applications by increase the packing friction unlike the helical actuator come with inherent, uncontrollable high unnecessary converting frictions, which waste 30 to 60% of fluid power energy and wear out the actuators prematurely, meanwhile it overcomes the inherent vane actuator lower holding capacity due to no linear/rotary converting frictions, second the embedded adjustable locking mechanism does not interfere with the shaft joint or shaft coupling for wider coupling selections especially for two or more dimension rotation applications, third it can be used for pump shaft or valve shaft seals, 80% of automated valve come with conventional packing assembly, the conventional packing assembly includes the packing, top gland and bolts, and is main causes for those stem leakages, those causes include the misalignment between valve shaft and actuator shaft or excessive compression on the packing, while this packing system has no external gland and bolts and eliminate the adapter and coupling joint errors, moreover the eccentric plug has the highest and lowest with the bearing between 12' clock and 6' clock positions for compressing control, so users can easily find out the limit of the packing adjustment and replace the packing before the packing loses sealing function, the smartness of the packing play a key role in today fugitive emission control under government regulations around the world like EPA in U.S, especially from 2020, in US, the fugitive emission standard would be less than 100 ppm, finally this shaft packing can be replaced with very low cost, while the helical actuators with inherent high friction would not only damage the seal ring and mated parts prematurely, but also have high cost to make, repair and replace.

The present invention discloses other breakthrough achievement—the air return mechanism instead of spring return, the air return mechanism with the shuttle valve not only does increases output force or torques without decreasing air acting forces, unlike the conventional spring return mechanism, which share the acting force about 40% and 10% converting loss from total capacity 100% of double acting forces or torque but also eliminates the spring return sets which is heavy, big and expensive and porn to corrosion with breath air holes, furthermore there is no entry of unfilled air into the actuator or air reservoir other than air supply, so no corrosion or particle would damage the actuator cylinder or air reservoir, more importantly the air return mechanism is constantly monitored by air pressure gauge and ready to act at any moment with the highest level of reliability, while spring set return is not constantly monitored, it can be weaken or corroded without any information of its condition for over time, under some working conditions like hot temperature, high humility or offshore platform, the air return reservoir can perform well at the designed condition for long service, where the spring return may not work well due to spring corrosion, creeping, finally the air return reservoir can be installed at any position, vertical, horizontal and between and with other actuators linear actuator, rack and pinion or vane actuators, there is no material fatigue issue, finally hot weather can help air return reservoir perform better without increasing heating cost or solar power consumption with heat absorbing material or dark color coating on the cylinder to increase pressure of the air on the reservoir or it can be added insulation layers and internal heater for cool weather locations or subsea as well, finally it is very suitable for earthquake area or high vibration applications, most actuators with spring return mechanisms are unbalanced, if with wet spring set, the matter even gets even worse, so the actuators may not even survive, to preform is out of question.

The thermal actuation system provides a revolutionized solution for actuation module assembly with basic thermal elements pressure sources like the compressor or the fluid pressurizer, the pressurized fluid reservoir and host gas heater exchanger and heater, unlike other systems like electrical or hydraulic power systems, the heat is bad for those system and waste energy and burn the wire or coils and cause shaft galling, even like gas over liquid actuators are widely used in gas pipelines for actuating line valves, but they are polluted air during actuating the valves, but this system has a safe way to burn nature gas as heat source through hot gas heat exchanger to increase the air temperature as well as pressure to power the valves in the gas pipeline, the system has the hot gas heat exchanger to burn the gas, which is much clear and safer in comparison with releasing high pressure nature gas on the gas over liquid actuators along with other heat sources like solar power to energize the electric heat tracing, further the air reservoir can be used at the bottom flange assembly as an insolation unit to protect the actuator for heat or cool fluid from those valves handling hot air in the jet or turbine engines or cryogenic fluid.

The control chamber assembly is the brain of the system in this invention, it combines all control elements, pre-set condition, sensing and judgment seamlessly as one unit at the highest level of adaptability and controllability for most control applications like the level control as the sense piston move up and down as a liquid level increase or decrease in the sensing cavity, or temperature control, as a temperate change in the sensing cavity, the piston can move up and down, or motion control and so on, the control chamber assembly is based on two human brain function with two systems; high level of control of the cerebrum system and a low level control of the cerebellum system, at the cerebrum system, the control chamber can make decision either to release, restore or block the line pressure and acts with or without electric signal or power and with a self-feedback function from the line pressure, while at the cerebellum system, it check the set pressure in the activity cavity against the line pressure in the sensing cavity with the center shuttle valve, safety valve, the pressure sensor as redundant devices, at the low level of control, the valve functions become simpler and is no longer to define a block valve or relief valve, just simple normal closed and normal open valves, it integrates this pressure protection system at the lightest level of reliability, simplicity and lowest level of barrier over all exiting pressure systems in the market or in research and over all prior arts, while electronic sensor, digital control, wireless communication devices still can be added on this system to communicate with other devices or human through buses like profit-bus, foundation bus or wireless communication, the control chamber system can be used for both linear or rotary actuation system and subsea BOP or valve or tree/well flow or pressure controls, so there is no block or release but release/block actuator, only single control chamber system, it not only increase integrity of protection system, but also simplify the valve design and selection and eliminate the partial stroke testing, by switching functions between normally open positions to normally closed in the two valves with full stroke test and increase the reliability.

The shuttle valves are truly universal valves for the first time and can be any kind of valve and the heart of the system in this invention to keep the fluid running in proper directions and react to the line pressure changes fast and precisely with the self-control, safe manner, without the shuttle valves or the control chamber, the High Integrity Pressure Protection System would not be truly created. For the first time, the innovative shuttle valve provide the hybrid sensing mechanism for both gas and liquid applications and has a novel shuttle, it has the sensing section and the seal section, because the hybrid sensing mechanisms are based on a solid-fluid dynamics to study interactions between solid and fluid, the basic physics is that solid with shape and volume, liquid with volume and gas without volume and shape due to strength of molecule bonding, those features play key role in the interactions between the shuttle head and fluid in the sensing bore, when fluid force−solid force (spring/solenoid) >0 (Newton second law is no longer applicable after seal breaks, because liquid has no shape, gas has no shape and volume!!!), solid of the head starts to move away from the seal section, and breaks seal, then fluid conditions change, liquid condition changes between pressure and velocity are based on the Bernoulli's equation with the concave profiles, so the concave profiles would smoothen any small condition change without negative effects as the head moves back and forth from the sensing bore, while gas condition changes between pressure and volume are based on the ideal or real gas law with the flat or convex profiles, they would provide enough the front volume to stabilize the condition changes as the head moves back and forth from the sensing bore, but if the concave profiles are used for gas applications, the oscillation and chatter could happen, while the flat or convex profiles are used for liquid applications, high pressure loss, vibration, cavitations and turbulent could happen. with a center fluid passage instead of external fluid passage, so the shuttle valve has double balanced seats unlike any other directional control valves spool or shear seal, it overcomes inherent radial spool sealing jamming or leakage due to erosion or cavitation, or high pre-stressed flat shear seal valve with high cost due to process, self-centering conical seal from both ends would keep the shuttle either front seal or back seal, since the front porting and back porting are locate evenly around the shuttle, any open/closed operation would not cause unbalanced wearing or reaction forces, while the middle groove with seal rings would prevent any possibility of inlet and outlet connection during transitions for some applications and creating full piston effect, moreover multiple middle grooves without the seal rings or with less friction of seal rings can help shuttle move evenly faster for some application requirements, also the hollow shuttle not only reduces the shuttle inertia with less weights but also stabilizes the movements of shuttle with a larger OD engaged surfaces especially for fast cycle operations, and is easily to control the directions of shuttle between forward or backward movements, in other hand, the changeable ratio between the opening area and closed pressure area make speed control much easy and pressure release time and reseating time shorter, moreover the shuttle with the extend tip can be actuated by a front pressure or acts like a limit switch in many applications like the control chamber as the piston assembly moves up, finally the shuttle valve has multiple control functions (1) front open, back closed positions (2) front closed/back open positions (3) front open/back open positions and (4) a two-shuttle valve combination become a counterbalanced control valve used for many hydraulic fluid control applications (5) a limit switch or manual switch for controlling flow instead of trigging by pressures (6) this shuttle valve can be operated as pressure regulator (7) this shuttle valve can be operated as a check valve, finally the hybrid sensing mechanism and the hybrid balance porting mechanism together provide the best solution for challenging applications like jet engine, gas turbine fuel delivery system and rock engine propulsion fluid system with high reliability and durability and make this fluid control system so powerful to solve the complicated problems with imbedded pressure protection feature.

Although the description above contains many specifications, these should not be construed as limiting the scope of the invention but as merely providing illustration of some of the presently preferred embodiments of this invention.

Thus, the scope of the invention should be determined by the appended claims and their legal equivalents, rather than by the examples given.

I claim:

1. A fluid process station has at least one fluid control system, the at least one fluid control system has a front access section having at least two front sensing ports and at least two back access sections, at least two valve subsystems disposed between said front access section and one of the at least two back access sections for providing various fluid controls, each of the two back access sections has at least one back sensing port, said fluid process station has a first of the at least one fluid control system having a first of the at least two valve subsystems functioning as a first normally open valve having an inlet port connected to said front access section and an outlet port, a second of the at least two valve subsystems functioning as a second normally open valve having an inlet port connected to said outlet port of the first normally open valve, an outlet port connected to a first of the at least two back access sections, a third of the at least two valve subsystems functioning as a first normally closed valve having an outlet port connected to a second of the at least two back access sections, an inlet port connected to said front access section, and a second of the at least one fluid control system having a first of the at least two valve subsystems functioning as a first normally open valve having an outlet port, an inlet port connected to said front access section, a second of the at least two valve subsystems functioning as a first normally closed valve having an outlet port, and an inlet port connected to said front access section, a third of the at least two valve subsystems functioning as a second normally open valve having an outlet port connected to a first of the at least two back access sections, and an inlet port connected to said outlet port of the first normally open valve, a fourth of the at least two valve subsystems functioning as a three way valve having an outlet port connected to said first of the at least two back access sections, a relief port connected to a second of the at least two back access sections, an inlet port connected to said outlet port of the first normally closed valve for directing flows between said outlet port of the three way valve and said relief port of the three way valve, and a third of the at least one fluid control system having a first of the at least two valve subsystems functioning as a first normally open valve having an outlet port and an inlet port connected to a first of the at least two back access sections, a second of the at least two valve subsystems functioning as a second normally open valve having an inlet port connected to said outlet port of the first normally open valve, an outlet port connected to said front access section, a third of the at least two valve subsystems functioning as a first normally closed valve having an outlet port connected to a second of the at least two back access sections, and an inlet port connected to said outlet port of the first normally open valve, a fourth of the at least two valve subsystems functioning as a third normally open valve having an outlet port, an inlet port connected to a third of the at least two back access sections, a fifth of the at least two valve subsystems functioning as a fourth normally open valve having an inlet port connected to said outlet port of the fourth normally open valve, an outlet port connected to said front access section, and a fourth of the at least one fluid control system having a first of the at least two valve subsystems functioning as a first normally open valve having an inlet port connected to said front access section, an outlet port, a second of the at least two valve subsystems functioning as a first control valve proportional valve having an inlet port connected to said outlet port of the first normally open valve, an outlet port connected to a first of the at least two back access sections, a third of the at least two valve subsystems functioning as a first normally closed valve having an outlet port connected to a second of the at least two back access sections, an inlet port connected to said front access section, and each of the at least two valve subsystems has a power supplier, a valve and an actuation-control section assembly coupled with said valve and said power supplier, said actuation-control section assembly has an actuation module assembly, a chamber control assembly, at least one shuttle valve and at least one fluid pad assembly, said power supplier has at least one of plurality of types including an external power supplier, a hot gas heat exchanger, a center heater, a fluid pressurizer, and a center pressurized fluid reservoir respectively connected with said hot gas heat exchanger, said center heater and said fluid pressurizer for providing fluid conditioning.

2. The fluid process station of claim 1, wherein the at least one shuttle valve has a shuttle body having a shuttle bore extending to a sensing bore having one of a plurality of shapes including a T shape and a L shape to provide sufficient fluids and a sufficient length for conditioning, at least two access ports, a shuttle having an internal port movably disposed in said shuttle bore, at least two seal rings, an adjustable back seat assembly, at least one spring biased between said shuttle and said adjustable back seat assembly, said shuttle has a head having a seal section, and a sensing section engaged with said sensing bore to form a sensing mechanism to sense one of plurality of forms of forces including fluid forces and non-fluid forces, said head and a peripheral of said sensing bore are made out of one of a plurality of materials including magnetic materials and non-magnetic materials, said sensing section has one of plurality of profiles including a concave profile, a flat profile and a convex profile, said shuttle and said shuttle bore have at least one link groove, said shuttle has at least one set of equally spanned passageways between the at least one link groove and said internal port for providing equal non-crossover fluid streams, and for centering said shuttle without rubbing and rotation, said shuttle has an end having multiple slots for releasing fluid, said shuttle bore and said shuttle have a back groove linked to said multiple slots.

3. The fluid process station of claim 1, wherein said actuation module assembly has at least one housing assembly, at least one drive assembly movably disposed in the at least one housing assembly dividing the at least one housing assembly into a cavity A and a cavity B, and at least two porting systems constructed between said cavity A and said cavity B through the at least one housing assembly and the at least one drive assembly, the at least one housing assembly has a housing, at least two external rigid corner seal rings, two flange assemblies respectively to sandwich said housing, and at least one housing vane assembly installed with said housing for providing reactionary torques, said housing has at least two external seal grooves respectively to receive the at least two external corner rigid seal rings, each of the at least two external corner rigid seal rings has a mated radius and two expendable sides for providing space of interference seals, the at least one housing vane assembly has at least two housing vane flexible seal rings, a housing vane having at least two external corner radii and at least two internal corner radii, at least two edge V grooves respectively to expend to multiple side holes, each of the at least two housing vane flexible seal rings respectively disposed in the at least two edge V grooves to form a left chamber, a right chamber and a bottom chamber for providing space of interference seals, a top seal surface, a left lower seal surface and a right lower seal surface for providing dynamic reactionary seals and preventing the at least two housing vane flexible seal rings from extrusion and pop-up, the at least two external corner radii of said housing vane are respectively engaged with the at least two external rigid corner seal rings for providing seals and supports, the at least one drive assembly has a shaft assembly having a shaft, at least one shaft vane assembly installed with said shaft assembly for providing active torques, at least two internal corner rigid seal rings, at least two corner seal ring grooves respectively to receive the at least two internal corner rigid seal rings, each of the at least two internal corner rigid seal rings has a mated radius and two expandable sides for providing space of interference seals, two removable covers respectively to sandwich said shaft vane assembly and said shaft assembly for eliminating shafts seals, equalizing top and bottom seal forces between said housing vane and said two removable covers, and centering the at least one drive assembly, the at least one shaft vane assembly has at least two shaft vane flexible seal rings, and a shaft vane having at least two external radii and at least two internal corner radii, at least two edge V grooves respectively expended to multiple side holes, each of the at least two shaft vane flexible seal rings respectively disposed in the at least two edge V grooves to form a left chamber, a right chamber and a bottom chamber for providing space of interference seals, a top seal surface, a left lower seal surface and a right lower seal surface for providing dynamic reactionary seals and preventing the at least two shaft vane flexible seal rings from extrusions and pop-ups, the at least two internal corner radii of said shaft vane are respectively engaged with the at least two internal corner rigid seal rings for providing seals and supports, said each of the at least two external corner rigid seal rings is engaged with each of the at least two external radii of said shaft vane by interference-mating, and engaged with said each of the at least two shaft vane flexible seal rings to be interference-mated to form dynamic inter-mating seals between said shaft assembly and said housing with five redundancy for preventing leaks from geometric imperfections and motion imperfections and various fluid conditions, said each of the at least two internal corner rigid seal rings is engaged with each of the at least two internal radii of said housing vane by interference-mating, and engaged with said each of the at least two housing vane flexible seal rings to be inference-mated to form dynamic inter-mating seals between said shaft assembly and the at least one housing vane assembly with five redundancy for preventing leaks from geometric imperfections and motion imperfections and various fluid conditions, said housing vane has at least one top slot and at least one bottom slot respectively engaged with said two removable covers, the at least one top slot has one of plurality of filling contents including sealants and pressure gases to form an independent fluid pressure equalized zone for providing differential dynamic seals, and preventing velocity differential crossover leaks, and pressure differential leaks, the at least one bottom slot has one of plurality of filling contents including sealants and pressure gases to form an independent fluid pressure equalized zone for providing differential dynamic seals, and preventing velocity differential crossover leaks and pressure differential leaks, said shaft assembly has at least one shaft adapter assembly having one of plurality of construction methods including being constructed as an independent part and being constructed as an integral part of said shaft.

4. The fluid process station of claim 3, wherein said actuation module assembly has a first of the at least two porting systems installed with said shaft assembly having a rotatable central porting device against said shaft having an access port A-1 and an access port B-1 restricted axially by at least one step and at least one retainer ring, and three seal rings, said access port A-1 is connected to said cavity A through said shaft and the at least one shaft vane assembly having a link groove A-1 expending to a first right L port, said access port B-1 is connected to said cavity B through said shaft and the at least one shaft vane assembly having a link groove B-1 expending to a first left L port, said three seal rings are respectively disposed between said rotatable central porting device and said shaft to seal off said link groove A-1 and seal off said link groove B-1, and a second of the at least two porting systems installed with said housing having an external porting ring assembly having an access port A-2 expanding to a radial groove A-2, an access port B-2 expanding to a radial groove B-2, said access port A-2 is connected to said cavity A through said radial groove A-2 expanding to a first left through port on a left side of said housing vane, said access port B-2 is connected to said cavity B through said radial groove B-2 expanding to a first right through port on a right side of said housing vane, said external porting ring assembly has one of plurality profiles including a cylindrical profile, a conical profile and a spherical profile, and a combination of said profiles, and a third of the at least two porting systems having an access port A-3, an access port B-3 on a first of said two flange assemblies, and a link groove A-3 and a link B-3 and three seal grooves to isolate said link groove A-3 from said link groove B-3 between said first of said two flange assemblies and a first of said two removable covers, and three seal rings respectively disposed in said three seal grooves for providing seals, said access port A-3 is connected to said cavity A through said link groove A-3 expanding to a first left internal port on a left side of the at least one shaft vane assembly, said access port B-3 is connected to said cavity B through said link groove B-3 expanding to a first internal right port on a right side of the at least one shaft vane assembly, and a fourth of the at least two porting systems installed with said housing having a fluid pad having an access port A-4 and an access port B-4, said access port A-4 is connected to said cavity A through a left though port on said left side of said housing vane, said access port B-4 is connected to said cavity B through a right though port on said right side of said housing vane.

5. The fluid process station of claim 4, wherein said actuation module assembly has a local fluid reservoir assembly installed on said first of said two flange assemblies to form a cavity AB for providing continuous return operation fluids without additional fluid suppliers, said local fluid reservoir assembly has a heater and a first of the at least one shuttle valve having a first of the at least two access ports, a second of the at least two access ports respectively connected to said access port A-3 and said access port B-3, a third of the at least two access ports is connected to said cavity AB, said first of the at least one shuttle valve has also a first of the at least two seal rings disposed between a front of said shuttle bore and said seal section of said head, a second of the at least two seal rings disposed between said end of said shuttle and said adjustable back seat assembly.

6. The fluid process station of claim 5, wherein said first of the at least one shuttle valve is functioned as a pressure regulator, said pressure regulator has said third of the at least two access ports used as a downstream port, said first of the at least two access ports connected to said downstream port used as a sensing port, said second of the at least two access ports used as a upstream port.

7. The fluid process station of claim 3, wherein said actuation module assembly has also at least one shaft packing assembly, at least one relative position adjustable device having at least two sets of fasteners and at least two fasteners for adjusting and securing relative positions between said two flange assemblies and said housing having at least two adjusting slots, the at least two sets of fasteners respectively penetrated into said two flange assemblies through the at least two adjusting slots and the at least two fasteners respectively penetrated into said two flange assemblies through said housing, each of said two flange assemblies has one of plurality of profiles including a cylindrical profile, a conical profile and a spherical profile and a combination of said profiles, at least two absolute position pads respectively disposed between said housing vane and said shaft vane for limiting said shaft rotary travel, the at least two absolute position pads are made out of one of materials including magnetic materials and non-magnetic materials, the at least one shaft adapter assembly has one of a plurality of types including a first type having at least two external pin slots between said shaft and the at least one shaft adapter assembly, and at least two external pins disposed in the at least two external pin slots, and at least two internal pin slots for shaft pin joints, a second type having at least two external pin slots between said shaft and the at least one shaft adapter assembly and at least two external pins disposed in the at least two external pin slots, and at least two internal pin slots and at least two setscrew sets for various shaft head joints, a third type having at least two external pin slots between said shaft and the at least one shaft adapter assembly and at least two external pins disposed in the at least two external pin slots, and at least two internal pin slots and at least two setscrew sets, at least two key/pin devices disposed in the at least two internal pin slots for shaft keyway joints, one of said two flange assemblies has a stuff box expanding to two side holes, the at least one shaft packing assembly has an adjustable bearing assembly and a packing set under said adjustable bearing assembly disposed in said stuff box, said adjustable bearing assembly has a bearing having a shaft bore to receive said shaft and at least two horizontal slots, at least two eccentric plugs and at least two fasteners to secure said plugs at an adjusted position and two retainer rings to secure said plugs at the adjusted position, each of the at least two eccentric plugs has a drive section respectively disposed in each of two side holes and an eccentric section engaged with said horizontal slot for moving said bearing up and down against said packing set.

8. The fluid process station of claim 3, wherein said actuation module assembly is constructed as a fluid powered hinge by fastening said first of said two flange assemblies assembled with said first of said two removable covers as a rotor against said housing with a second of said two flange assemblies as a stator for providing hinge rotary movements and torque, a third of the at least two external corner rigid seal rings disposed between said rotor and said stator for providing bearing and seal functions, said fluid powered hinge has one of plurality of profiles including a cylindrical profile, a conical profile and a spherical profile, and a combination of said profiles.

9. The fluid process station of claim 3, wherein said actuation module assembly is constructed as a symmetrical fluid powered hinge by fastening respectively said two flange assemblies assembled with said two removable covers as a rotor against said housing as a stator for providing hinge rotary movements and torques, a fourth and a fifth of the at least two external corner rigid seal rings respectively disposed between said rotor and said stator for providing bearing and seal functions, said symmetrical fluid powered hinge has one of plurality of profiles including a cylindrical profile, a conical profile and a spherical profile and a combination of said profiles.

10. The fluid process station of claim 9, wherein at least two of said symmetrical fluid powered hinges are constructed as a multiple dimensional actuation module assembly for providing at least two dimensional rotations.

11. The fluid process station of claim 3, wherein said dynamic inter-mating seals are constructed in a seal device for providing dynamic seals, said seal device has a first seal element and a second seal element engaged with said first seal element to form said dynamic inter-mating seals with at least two redundancy for preventing leaks from geometric imperfections, motion imperfections and various fluid conditions, said first seal element has at least one active structural seal surface and at least one active seal surface made out of one of plurality of materials including flexible materials and rigid materials, and said second seal element has at least one passive structural seal surface engaged with the at least one active seal surface to be interference-mated and at least one passive seal surface engaged with the at least one active structural seal surface by interference-mating, the at least one passive seal surface is made out of one of plurality of materials including flexible materials and rigid materials.

12. The fluid process station of claim 1, wherein said chamber control assembly has a control housing having a ceiling entry boss communicated to said power supplier and a large bore extending to a small bore, a control piston assembly movably disposed in said control housing forming an active chamber and a sensing chamber, said sensing chamber is connected to a first of the at least two front sensing ports, said active chamber is communicated to the at least one fluid pad assembly and said power supplier, said control piston assembly has a large mated cylinder and a small mated cylinder respectively engaged with said large bore and said small bore, a top boss engaged with said ceiling entry boss for providing seals when said control piston assembly reaches a preset condition, said control piston assembly has a shuttle valve bore extending to a sensing hole on said top boss, a piston back groove extending to multiple relief holes, said chamber control assembly has a second of the at least one shuttle valve disposed in said shuttle valve bore for releasing pressures in said active cavity at a preset limit, said second of the at least one shuttle valve has a first of the at least two access ports connected to said sensing hole, a first of the at least two seal rings disposed between a front of said shuttle bore and said seal section of said head, a second of the at least two access ports connected to said multiple relief holes through said back groove and a bottom of said back seat assembly, said chamber control assembly also has a pressure relief valve and multiple sensors.

13. The fluid process station of claim 12, wherein said second of the at least one shuttle valve is functioned as a check valve, said check has said first of the at least two access ports used as a upstream port, said second of the at least two access ports used as a downstream port.

14. The fluid process station of claim 1, wherein the at least one fluid pad assembly has a fluid pad having said port A-4 and said port B-4, a third of the at least one shuttle valve having a first of the at least two access ports connected to said port A-4, a second of the at least two access ports connected to said port B-4, a third of the at least two ports extending to outsides of the at least one fluid pad assembly, said sensing section has said concave profile having a cylinder and a groove engaged with said sensing bore for providing piston effects, a first of the at least two seal rings disposed in said groove and a second of the at least two seal rings disposed between a front of said shuttle bore and said seal section, a third of the least two seal rings disposed between said end of said shuttle and said adjustable back seat assembly.

15. The fluid process station of claim 14, wherein said third of the at least one shuttle valve is functioned as a pressure regulator, said pressure regulator has said third of the at least two access ports used as a upstream port, said second of the at least two access ports used as a downstream port, said first of the at least two access ports connected to said downstream port used as a sensing port.

16. The fluid process station of claim 14, wherein said third of the at least one shuttle valve is functioned as a pressure regulator, said pressure regulator has said third of the at least two access ports used as a upstream port, said second of the at least two access ports used as a downstream port, said first of the at least two access ports connected to said downstream port used as a sensing port.

17. The fluid process station of claim 14, wherein said third of the at least one shuttle valve is constructed as a counter-balanced valve, said counter-balanced valve has two internal access ports and two external access ports for preventing uncontrolled movement of loads.

* * * * *